US012781574B2

(12) United States Patent
Clark et al.

(10) Patent No.: US 12,781,574 B2
(45) Date of Patent: Nov. 3, 2026

(54) DRILL BIT CUTTER POCKET WITH STRESS REDUCING FEATURES

(71) Applicant: Halliburton Energy Services, Inc., Houston, TX (US)

(72) Inventors: Kevin Clark, Willis, TX (US); Yi Pan, Conroe, TX (US); Randy T. Howell, Conroe, TX (US); Jeffrey G. Thomas, Conroe, TX (US); Nicholas Allison, Conroe, TX (US); John W. Varner, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/209,198

(22) Filed: Jun. 13, 2023

(65) Prior Publication Data

US 2023/0407709 A1 Dec. 21, 2023

Related U.S. Application Data

(60) Provisional application No. 63/353,252, filed on Jun. 17, 2022.

(51) Int. Cl.
*E21B 10/573* (2006.01)

(52) U.S. Cl.
CPC ..... *E21B 10/5735* (2013.01)

(58) Field of Classification Search
CPC .... E21B 10/573; E21B 10/5735; E21B 10/43; E21B 10/62; E21B 10/627; E21B 10/633; E21B 10/58; E21B 10/567; E21B 10/06
See application file for complete search history.

(56) References Cited

U.S. PATENT DOCUMENTS

| | | | | |
|---|---|---|---|---|
| 2,784,943 | A * | 3/1957 | Bylund | E21B 10/38 175/420.1 |
| 3,563,325 | A * | 2/1971 | Miller | E21B 10/58 175/420.1 |
| 4,711,144 | A * | 12/1987 | Barr | E21B 10/62 228/139 |
| 7,389,834 | B1 | 6/2008 | Kembaiyan | |
| 7,661,765 | B2 | 2/2010 | Hall et al. | |
| 7,740,090 | B2 | 6/2010 | Shen et al. | |

(Continued)

FOREIGN PATENT DOCUMENTS

| | | |
|---|---|---|
| CN | 109108295 | 1/2019 |
| CN | 211219252 | 8/2020 |

(Continued)

*Primary Examiner* — Yanick A Akaragwe
(74) *Attorney, Agent, or Firm* — Michael Jenney; C. Tumey Law Group, PLLC

(57) ABSTRACT

A variety of methods, systems, and apparatus are disclosed, including, in one embodiment, a drill bit, comprising: a bit body defining a rotational axis and having a plurality of cutter pockets formed thereon, each cutter pocket shaped to receive a respective substrate of a cutter; wherein each cutter pocket has an inner profile that defines an area of increased braze gap that conforms to an outer profile of the respective substrate; and a braze interface comprising a braze alloy disposed in each cutter pocket between the inner profile of the cutter pocket and the outer profile of the respective substrate, such that a thickness of the braze alloy is greater at the area of increased braze gap.

19 Claims, 14 Drawing Sheets

(56) References Cited

U.S. PATENT DOCUMENTS

| | | | | |
|---|---|---|---|---|
| 8,074,869 | B2 | 12/2011 | Lyons et al. | |
| 8,360,176 | B2 | 1/2013 | Zhang et al. | |
| 8,439,137 | B1 | 5/2013 | Galloway | |
| 8,777,088 | B2 | 7/2014 | Trinh et al. | |
| 8,863,864 | B1 | 10/2014 | Miess | |
| 9,303,460 | B2 | 4/2016 | Schwefe et al. | |
| 9,488,012 | B2 | 11/2016 | Thigpen | |
| 9,580,969 | B2 | 2/2017 | Wardley et al. | |
| 9,987,726 | B2 | 6/2018 | Olsen | |
| 10,240,398 | B2 | 3/2019 | Anderle et al. | |
| 10,352,103 | B2 | 7/2019 | Maw | |
| 2004/0245022 | A1 | 12/2004 | Zaguirre et al. | |
| 2010/0276210 | A1 | 11/2010 | Prajapati et al. | |
| 2010/0288563 | A1 | 11/2010 | Smith | |
| 2012/0090900 | A1* | 4/2012 | Prajapati | B23K 1/0008 175/428 |
| 2016/0017668 | A1 | 1/2016 | Meier et al. | |
| 2016/0201399 | A1 | 7/2016 | Bird et al. | |
| 2016/0256947 | A1 | 9/2016 | Arfele | |
| 2017/0191315 | A1 | 7/2017 | Saini et al. | |
| 2017/0292330 | A1* | 10/2017 | Zhang | E21B 10/567 |
| 2018/0128055 | A1 | 5/2018 | Saini et al. | |
| 2018/0169796 | A1 | 6/2018 | Clark et al. | |
| 2023/0151698 | A1 | 5/2023 | Russell et al. | |

FOREIGN PATENT DOCUMENTS

| | | |
|---|---|---|
| GB | 2479844 | 10/2011 |
| WO | 2010088504 | 8/2010 |
| WO | 2015072980 | 5/2015 |

* cited by examiner

DRILL BIT CUTTER POCKET WITH STRESS REDUCING FEATURES

CROSS-REFERENCE TO RELATED APPLICATIONS

The present application is a non-provisional of U.S. Patent Provisional Application No. 63/353,252, filed Jun. 17, 2022, the entire disclosure of which is incorporated herein by reference.

BACKGROUND

A well is drilled by rotating a drill bit at the end of a drill string. The entire drill string may be rotated using surface equipment, and/or the bit may be rotated relative to the drill string with a downhole motor. The well may be drilled to any desired depth by progressively adding segments of drill pipe from the surface of the wellsite. While drilling, drilling fluid is pumped down the drill string, through nozzles on the drill bit, and up an annulus between the drill string and wellbore to lubricate the bit and remove cuttings and other debris to the surface. The process of drilling thus exposes drill bits and other drilling equipment to extreme conditions such as high stresses, temperatures, and wear.

A fixed cutter drill bit is a type of drill bit having a plurality of cutters secured at fixed positions to a bit body. Each cutter may include a cutting table made of an ultra-hard material, such as polycrystalline diamond or boron nitride, secured to a carbide substrate. A fixed cutter bit body is formed from a high strength material, with a plurality of cutter pockets formed on the bit body. Each cutter pocket receives one cutter, which is secured to the pocket by brazing. Over time, the drill bit may gradually wear and/or fail from high forces exerted on the drill bit as it bears against the formation while drilling. Over time, the drill bit may gradually wear and/or fail from high forces exerted on the drill bit as it bears against the formation while drilling.

It is common to have to replace worn or damaged cutters, or even an entire drill bit, in the course of drilling a well. Drilling is very time- and cost-intensive, and the extra rig time incurred to trip out of the wellbore and repair or replace a bit can be expensive. A great deal of effort and expense has therefore been devoted to improving the durability of drill bits. Much of this focus over the years has been on improving the diamond materials used in cutters to make them harder, tougher, and more wear resistant.

BRIEF DESCRIPTION OF THE DRAWINGS

These drawings illustrate certain aspects of some of the embodiments of the present disclosure and should not be used to limit or define the disclosure.

DETAILED DESCRIPTION

Figure 1:
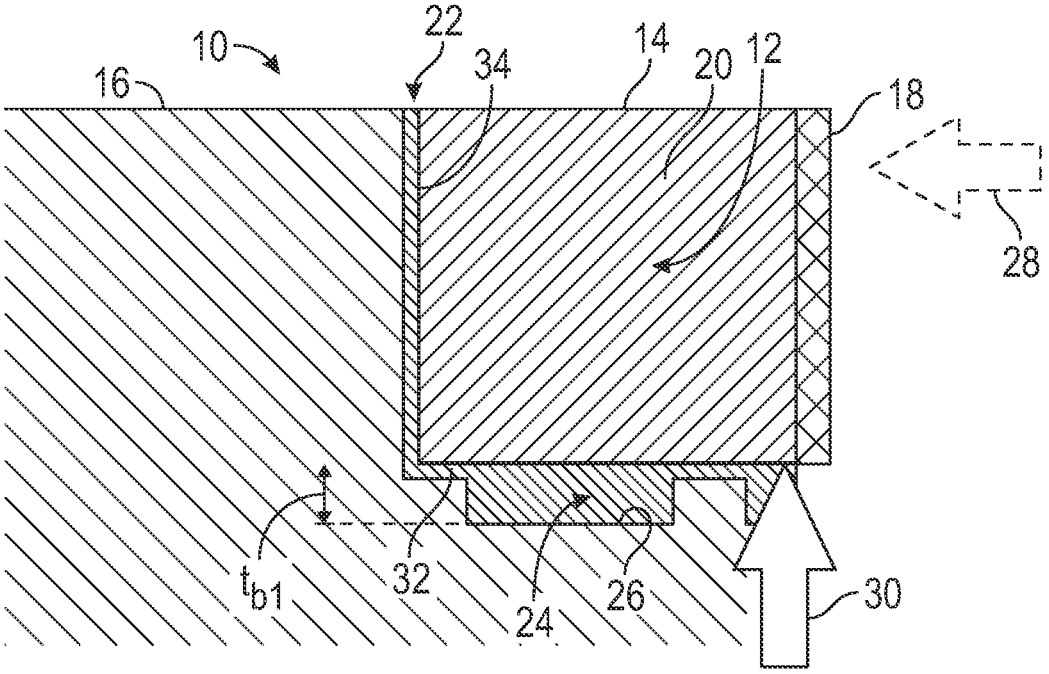
FIG. 1 is a schematic view of a test configuration for a cutter pocket in accordance with some embodiments of the present disclosure.

The present disclosure is generally related to drill bits and, more particularly, to improving longevity of fixed cutter drill bits by improving the brazing interface of the cutters with the cutter pockets of a bit body. For example, example embodiments relate to creating a more compliant braze joint that reduces the stress in the system as compared with a thin and uniform braze layer. The disclosure encompasses, without limitation, a braze joint, a drill bit incorporating such a braze joint, a method of designing such a drill bit, and a method of drilling with such a drill bit.

In general, a properly made brazed joint will be as strong or stronger than the metals being joined. In a typical cutter, the substrate material being joined to the cutter pocket is tungsten carbide, which may have a tensile strength on the order of 350 MPa and a compressive strength on the order of 4780 MPa. One of the stronger joints achievable, on the order of 135,000 psi (930.8 MPa), is achieved when the joint clearance is 0.0015 inches (0.038 mm.) When the clearance is narrower than this, it can be harder for the filler metal to distribute itself adequately throughout the entire joint and joint strength is reduced. Conversely, if the gap is wider than necessary, the strength of the joint will be reduced almost to that of the filler metal itself.

Conventional understandings and approaches with brazing that have called for using a very thin and uniform braze layer along the entire interface between the cutter substrate and the cutter pocket. A typical braze joint has a uniform layer of braze at the back and sides of a cutter pocket, with possible exception at a corner (e.g., chamfer or fillet) between the back and sides. However, an aspect of this disclosure is to manage the strength of the braze interface by manipulating the braze gap to have a lower strength (thicker) braze gap in areas of higher tension and higher strength (thinner) braze gap in areas of higher compression loads relative to the forces induced by drilling.

Example embodiments of the present disclosure generally focus on the shape of the cutter pocket, including selecting (e.g., designing, forming, and/or modifying) the shape of a cutter pocket where it interfaces with the cutter, to selectively increase a resultant braze thickness between the cutter and cutter pocket at preselected locations. However, in some examples the cutter itself may also be selected (e.g., designed, formed, and/or modified) to selectively increase the resultant braze thickness. A gap between the cutter and the cutter pocket may define a gap to be occupied by a braze material, i.e., a braze gap. The braze that fills the gap may have a corresponding braze thickness. Thus, the braze is thicker within the area of increased braze gap than outside the area of increased braze gap. An area of increased braze gap may include, for example, a recess or a taper defined by an inner profile of the cutter pocket (and/or an outer profile of the respective cutter in some examples). Additional areas of increased braze gap may include a spacer on the inner profile of the cutter pocket. Thus, an area of increased braze gap may be created by designing, forming, and/or modifying the cutter and/or cutter pocket. This variable braze thickness may spread out or otherwise redistribute the loading at the braze interface, giving the cutter the ability to take a higher load before it fractures. This aspect of a variable braze thickness challenges or defies conventional understandings and approaches with brazing that have called for using a very thin and uniform braze layer along the entire interface between the cutter substrate and the cutter pocket. Aspects of the disclosure help to mitigate the stress in the carbide and braze joint that help to improve cutter retention and cutter life. This may also enable drilling more challenging applications that ordinarily would have a high cutter fracture rate.

In examples, the redistribution of stress at the braze interface may be accomplished by incorporating one or more recesses and/or tapers in the cutter pocket in specific areas that allow for a thicker braze joint in those areas. In other examples, the redistribution of stress at the braze interface may be accomplished by incorporating a spacer on the inner profile of the cutter pocket in specific areas that allow for a thicker braze joint in those areas. In yet other examples, incorporation of a one or more recesses or other configurations in the inner profile of the cutter pocket may allow for a thicker braze joint at other areas of the cutter pocket. Recent testing under certain configurations and conditions reveals that the thicker portion of the braze joint is more ductile and allows the cutter to move slightly more than it otherwise would with a thin and uniform braze layer. This very small movement allows the cutter load to be spread out across the joint versus being concentrated in one area. Spreading the load out, in turn, reduces the stress in the system.

Analytical techniques such as finite element analysis (FEA) simulations and calculations (as generally understood in the art apart from the specific teachings of this disclosure), applied to evaluate stress on the cutters and specifically at the braze joints, have found that the stress in the braze layer and the cutter is reduced by increasing the braze layer thickness. Cutters and cutter materials may last longer, even without any further improvements to the diamond used in the cutting table. Testing has also confirmed that the carbide fracture load increased when a central recess was introduced to the cutter pocket. In at least some configurations, such a recess may have a depth in the range of between 0.010 inches and 0.040 inches (0.254 mm to 1.016 mm) and an angle in a range of 20 degrees to −90 degrees. In one example, FEA results suggest a recess comprising an annular groove (discussed below, e.g., see general shape of recess 20, FIG. 1) with a thickness of 0.03 inches (0.762 mm thick) and a length of 0.2 inches (5.08 mm length) with an expanding 60-degree angle yield minimum stress in the carbide and the braze layer.

The cutter (as discussed further below and illustrated regarding specific example configurations) may define a cutter axis useful as reference geometry, which in the example of a cutter with a cylindrical or otherwise round cross section may be the centerline. In some example configurations, the recess may be provided on the cutter pocket along an annular groove between the substrate and the respective cutter pocket. The gap width (e.g., as measured circumferentially), depth (e.g., as measured radially), and/or length (e.g., as measured axially) can be optimized for the desired stress reducing effects. In some examples, the gap could span less than 180 degrees, and may be located in a region where the braze is in tension during drilling loading. In other examples, the gap could exceed 180 degrees, up to a continuous annular groove effectively spanning 360 degrees. In some examples, an optimal angle may be on the order of an angular width of 60 degrees, a depth of 0.03 inches (0.762 mm), and a length of 0.2 inches (5.08 mm) long among the candidate angles (60 degrees to 120 degrees), depths (0.005 inches to 0.03 inches (0.127 mm to 0.762 mm)) and lengths (0.2 inches to 0.4 inches (5.08 mm to 10.16 mm).

In other example configurations, a recess formed on the cutter pocket may be adjacent to the back of the cutter, i.e., adjacent the bottom end of the cutter opposite the cutting table. This recess location may help reduce the braze gap in the back of the pocket in the area of highest compressive loading. A smaller gap close to zero will allow better load transfer which again will reduce cutter stress. Such a gap could be built as designed and with it being wider in the areas with higher tensile/lower compressive loads and approaching zero in the higher compression/lower tensile loads. In use there would be some compliance, but it would be on the order of 0.0001 inches (0.00254 mm) and could be in a range of between 0.00005 inches to 0.005 inches (0.00127 mm to 0.127 mm).

In some embodiments, a drill bit may be desired, for example, to have improved brazing at the interface of the cutters with the cutter pockets of a bit body. For example, an expected loading may be obtained for a plurality of fixed cutters received in pocket of a bit body. From at least this loading, one or regions may be identified to increase a thickness of a braze interface between each fixed cutter and a cutter pocket. In addition, the shape of the cutter pocket may be selected to increase the resultant braze thickness at the one or more regions to spread out or otherwise redistribute the loading at the braze interface. Selecting the shape may include designing, forming, or otherwise modifying the shape of the cutter pocket. In some embodiments, identifying one or more regions to increase a thickness of a braze interface comprises may include identifying a region where the braze interface is expected to be in tension, and wherein the selecting the shape of the cutter pocket to increase the resultant braze thickness at the one or more regions comprises positioning a recess at the region where the braze interface is expected to be in tension. In some embodiments, selecting the shape of the cutter pocket comprises defining an annular recess between the cutter pocket and the respective substrate. In some embodiments, selecting the shape of the cutter pocket comprises defining a recess on a bottom end of the cutter pocket. In some embodiments, selecting the shape of the cutter pocket comprises defining a recess on a bottom end of the cutter pocket and an annular recess between the cutter pocket and the respective substrate.

FIG. 1 is a schematic view of a test fixture 10 for a cutter pocket 12 in accordance with some embodiments of the present disclosure. The test fixture is intended to simulate in some ways the mounting of a fixed cutter ("cutter") 14 in respective cutter pocket 12 on a fixed cutter bit body. In the illustrated, embodiment, the cutter pocket 12 is formed in a representative body 16, which may be a portion of a bit body, for example. As illustrated, the cutter 14 may include a cutting table 18 (not shown), such as polycrystalline diamond (PCD), mounted on a substrate 20 that is brazed into the cutter pocket 12. The cutters 14 on a bit are positioned by virtue of their orientations on the bit body to directly engage an earthen formation during drilling.

In the text fixture of FIG. 1, the cutter 14 being used as a test cutter is brazed into a cutter pocket 14, which is partially cut away in order to apply a test load. The braze 32 has a uniform thickness in the braze gap 22, except at an area of increased braze gap, where the braze interface is thicker. The area of increased braze gap is a recess 24 of a uniform diameter recess in this example; alternative example configurations of an increased braze gap could include a recess 24 with a non-uniform diameter (e.g., a taper). As illustrated, the recess 24 may be formed in an inner profile 26 of the cutter pocket 12.

During drilling, a resultant cutter loading may be applied to the cutting table 18 in the direction shown by arrow 28. The cutter loading during drilling may comprise a reaction force at the formation engaged by the cutting table 18. The cutter loading is represented as a vector whose magnitude and direction may differ from the simplification in the drawing. The cutter loading would tend to create a region of tension in the braze 32 in the region of the recess 24, and a region of compression at the back (i.e., bottom end 34) of the cutter 14. Likewise, a cutaway test pocket can allow a test load to be applied that also creates tension at the recess 24 and compression at the bottom end 34 of the cutter 14. This test load is represented by arrow 30. The same experiment may be performed electronically such as part of a design simulation. It has been determined that under certain parameters having a greater thickness ($t_{b1}$) of the braze 32 at the recess 24 allows that portion of braze 32 to deform a little further than a thinner layer would, causing a beneficial redistribution of forces elsewhere in the braze 32.

Figure 2:
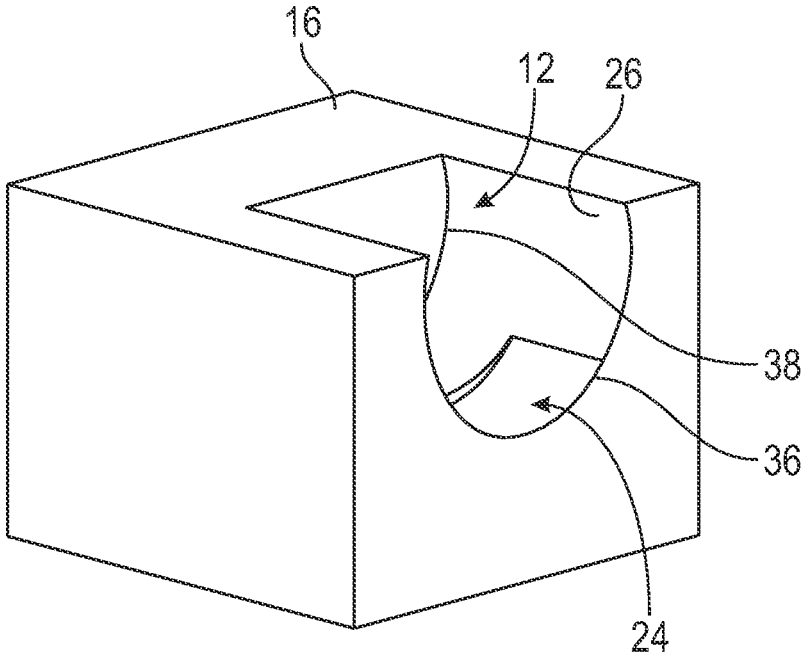
FIG. 2 is a perspective view of a cutter pocket in accordance with some embodiments of the present disclosure.

FIG. 2 illustrates a representative body 16, which may be a portion of a bity body, for example, in accordance with some embodiments. As illustrated, a cutter pocket 12 may be formed in the body 16. The cutter pocket 12 may have an inner profile 26. In accordance with example embodiments, the cutter pocket 12 includes one or more features to selectively increase a thickness of a braze layer. For example, a recess 24 comprising an annular groove may be formed in the inner profile 26 of the cutter pocket 12. The recess 24 is radially protruding into the body 16 and extends an axial length. The recess 24 in this example extends from a pocket front 36 and terminates before the pocket back 38. However, in other embodiments, the recess 24 may extend all the way to the pocket back 38 and/or terminate before the pocket front 36. In addition, the recess 24 extends only partially around the inner profile 26. However, in other embodiments, the recess 24 may extend around the full circumference of the inner profile 26.

Figure 3:
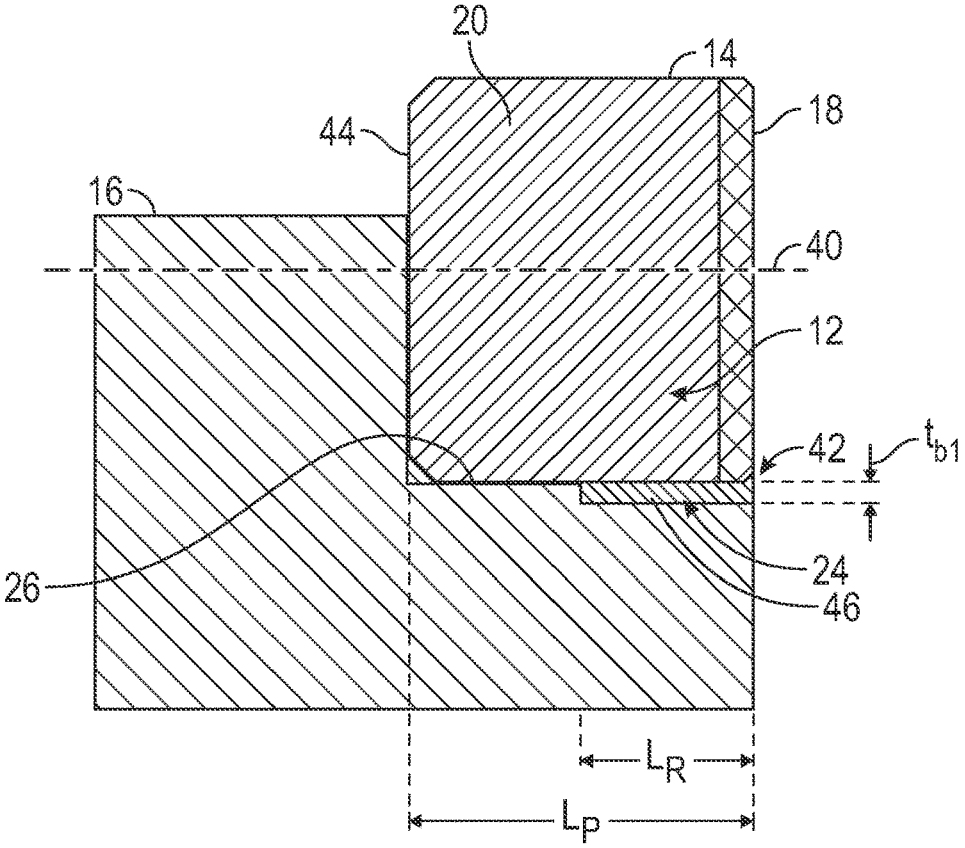
FIG. 3 is a cross-sectional side view of the cutter pocket of FIG. 1 with a cutter mounted in the cutter pocket in accordance with some embodiments of the present disclosure.

FIG. 3 illustrates a cutter 14 installed in the cutter pocket 12 of FIG. 2 in accordance with some embodiments. As illustrated, the cutter 14 has a cutting table 18 secured to a substrate 20. The substrate 20 may be formed of a very hard material, such as a carbide (e.g., tungsten carbide or WC). The cutting table 18 may be formed of an even harder material, such as polycrystalline diamond (PCD), which is positioned by virtue of its orientation on the bit body (e.g., body 16) to directly engage an earthen formation during drilling, while supported on the substrate 20 as mounted to a drill bit body (e.g., body 16). The cutting table 18 may be simultaneously formed in a press by bonding diamond particles to themselves and to the substrate 20 during a high-temperature, high-pressure (HTHP) sintering process. The shape of the cutter 14, including the substrate 20 and/or cutting table 18, may be achieved, at least in part, by the shape of a vessel (e.g., pressing can) in which it is formed during sintering, and may be further formed or shaped after sintering according to any suitable technique, such electro discharge machining (EDM).

The cutter 14 defines a cutter axis 40. The cutter pocket 12 has a length ($L_P$) in an axial direction aligned with the cutter axis 40. The recess 24 is formed on the outer profile 26 of the cutter pocket 23. The recess 24 is radially protruding into the body 16 and extends axially a length ($L_R$) for example, of between 5% to 90% of the overall length ($L_P$)

of the cutter pocket 12. For example, the recess 24 may have a length ($L_P$) of 0.001 inches to 0.1 inches (0.254 mm to 2.54 mm).

As illustrated, the cutter 14 may be received in the cutter pocket 12 formed in the body 16. A gap or recess 42 comprising an annular groove exists between the outer profile 44 of the cutter 14 (or at least of the substrate 20, as at least a portion of the cutter 14 extends outside the cutter pocket 12) and the inner profile 26 of the cutter pocket 12 into which the cutter 14 is to be received. The cutter 14 may be secured within the cutter pocket 12 via a brazing process. That is, a braze material (i.e., a "braze) 46 may be melted and directed to flow into the gap or recess 42 between the outer profile 44 of the substrate 20 and the inner profile 26 of the cutter pocket 12. The braze 46 may fill the entire space between the outer profile 44 of the substrate 20 and the inner profile 26 of the cutter pocket 12. Once cooled, the braze 46 joins the cutter 14 to the cutter pocket 12. The braze may include any suitable braze alloy. For example, the braze 46 may include copper, nickel, silver, or gold-based alloys that include other constituents such as tin, zinc, titanium, zirconium, nickel, manganese, tellurium, selenium, antimony, bismuth, gallium, cadmium, iron, silicon, phosphorous, sulfur, platinum, palladium, lead, magnesium, germanium, carbon, oxygen, as well as other elements. Moreover, the outer profile 44 and inner profile 26 are generally shaped to conform to one another, except that the gap 42 is thicker at the recess 24. The term braze interface in this context may refer to the entirety of the braze 46 at this interface. A uniform layer (e.g., less than 0.010 inches (0.254 mm)) of the braze 46 may be formed in the gap 42 outside the recess 24. The layer of the braze 46 will be thicker at the recess 24 than outside the recess 24. In some cases, a depth of the recess 24 and a corresponding thickness ($t_{b1}$) of the braze 46 in the recess 24 may be between 0.010 inches and 0.040 inches (0.254 mm to 1.016 mm), and the thickness of the braze 30 outside the recess 16 ($t_{b2}$) will be thinner than the layer of the braze 30 in the recess 16, such as less than 0.010 inches (0.254 mm). The braze 30 may have a uniform thickness (($t_{b2}$) throughout the braze interface between the outer profile 44 of the cutter 14 and the inner profile 26 of the cutter pocket 12 except for in the recess(s) 46.

Figure 4:
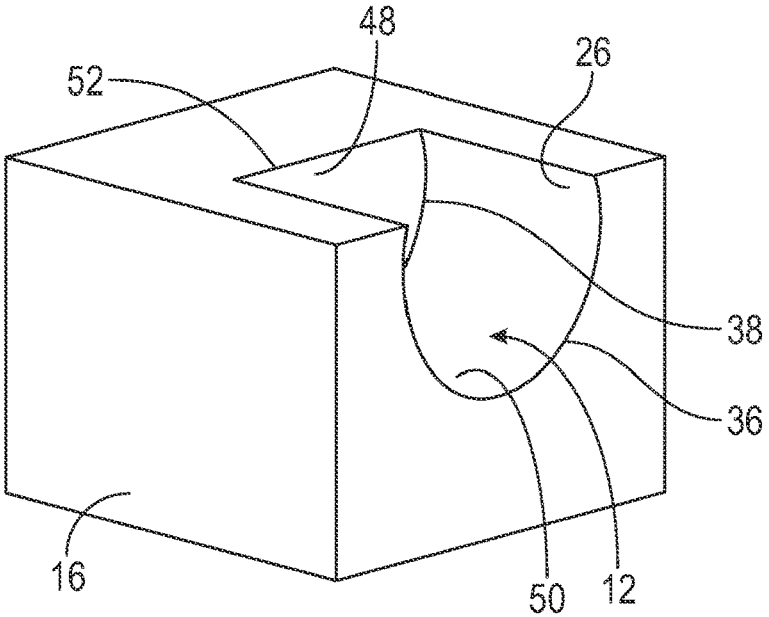
FIG. 4 is a perspective view of a cutter pocket in accordance with some embodiments of the present disclosure.

FIG. 4 is a perspective view of a body 16 having a cutter pocket 12 formed therein in accordance with additional embodiments of the present disclosure. The cutter pocket 12 may have tapers formed in the inner profile 26 to selectively increase the thickness of the braze layer. For example, the inner profile 26 may have a back surface 48 and a bottom surface 50. One or both of the back surface 48 and the bottom surface 50 may include tapers to selectively increase the thickness of the braze layer. For example, the back surface 48 and the bottom surface 50 may each be ramped surfaces. The bottom surface 50 in this example tapers from the pocket front 36 to the pocket back 38. However, in other examples, the taper of the bottom surface 50 may not extend fully to the pocket front 36 and/or the pocket back 38 but rather may only be tapered for a portion of the bottom surface. The back surface 48 in this example tapers from the pocket back 38 to the pocket top 52. However, in other examples, the taper of the back surface 48 may not extend fully to the pocket top 52 and/or the pocket back 38 but rather may only be tapered for a portion of the back surface 48.

Figure 5:
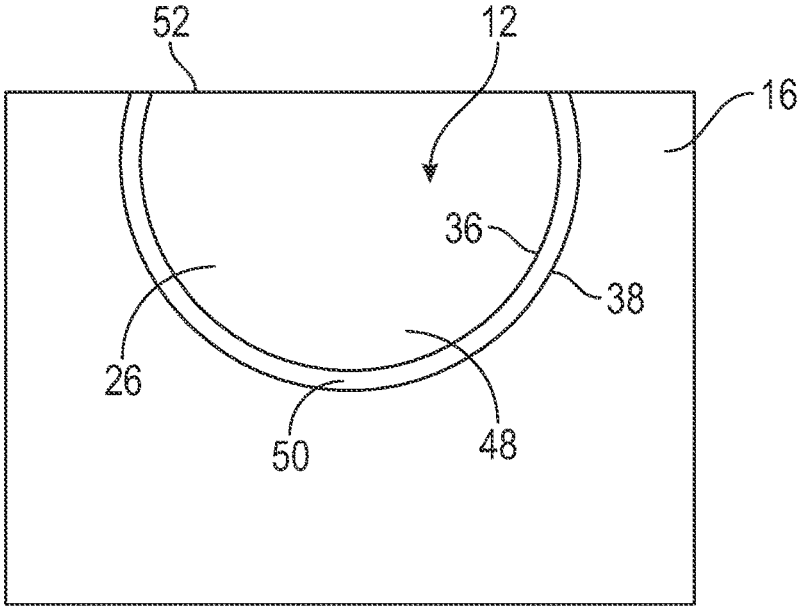
FIG. 5 is a front view of the cutter pocket of FIG. 4 in accordance with some embodiments of the present disclosure.

FIG. 5 is a front view of the body 16 of FIG. 4 having the cutter pocket 12 formed therein in accordance with additional embodiments of the present disclosure. As illustrated, the inner profile 26 includes a back surface 48 and a bottom surface 50 that both include tapers to selectively increase the thickness of the braze layer. The bottom surface 50 in this example tapers from the pocket front 36 to the pocket back 38. The back surface 48 in this example tapers from the pocket back 38 to the pocket top 52.

Figure 6:
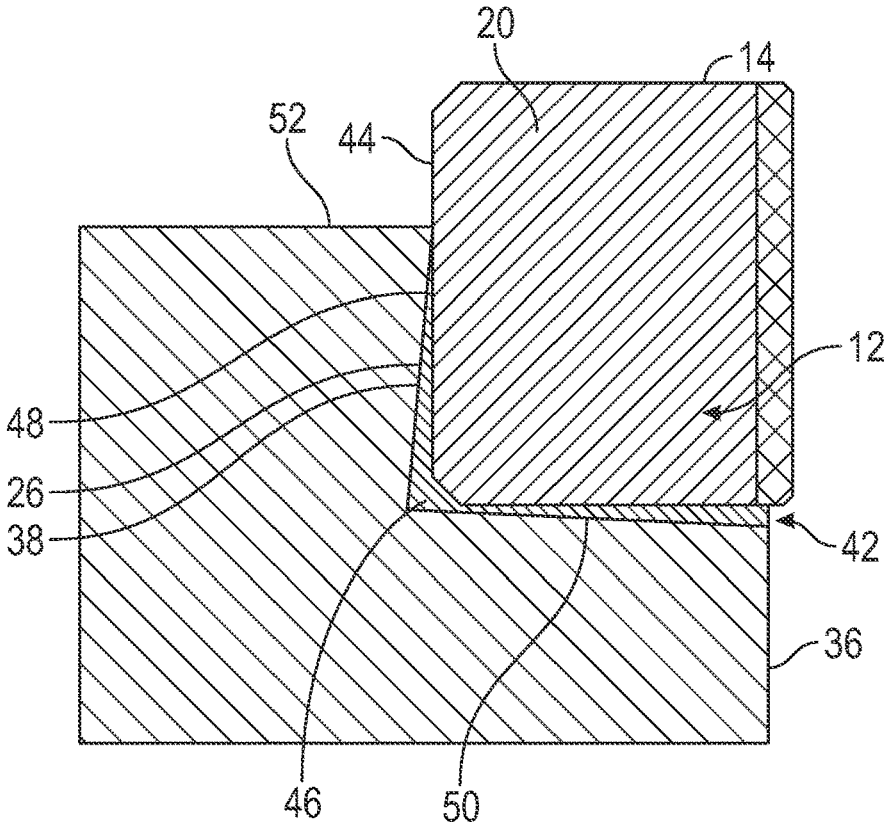
FIG. 6 is a cross-sectional side view of the cutter pocket of FIG. 4 with a cutter mounted in the cutter pocket in accordance with some embodiments of the present disclosure.

FIG. 6 illustrates a cutter 14 installed in a cutter pocket 12 in accordance with some embodiments. The cutter pocket 12 may have similar attributes as the cutter pocket 12 in FIGS. 4 and 5. For example, the cutter pocket 12 includes tapers in the inner profile 26 to selectively increase the thickness of the braze layer. The bottom surface 50 in this example tapers from the pocket front 36 to the pocket back 38. The back surface 48 in this example tapers from the pocket back 38 to the pocket top 52. A gap or recess 42 comprising an annular groove exists between the outer profile 44 of the cutter 14, and the inner profile 26 of the cutter pocket 12 into which the cutter 14 is to be received. A braze material (i.e., a "braze) 46 is a material, e.g., a braze alloy, used to secure the cutter 14 into the cutter pocket 12. The braze 46 may fill the entire space between the outer profile 44 of the substrate 20 and the inner profile 26 of the cutter pocket 26 with the braze 46 have a thickness that gradually decreases along the taper of the back surface 48 and the bottom surface 50.

Figure 7:
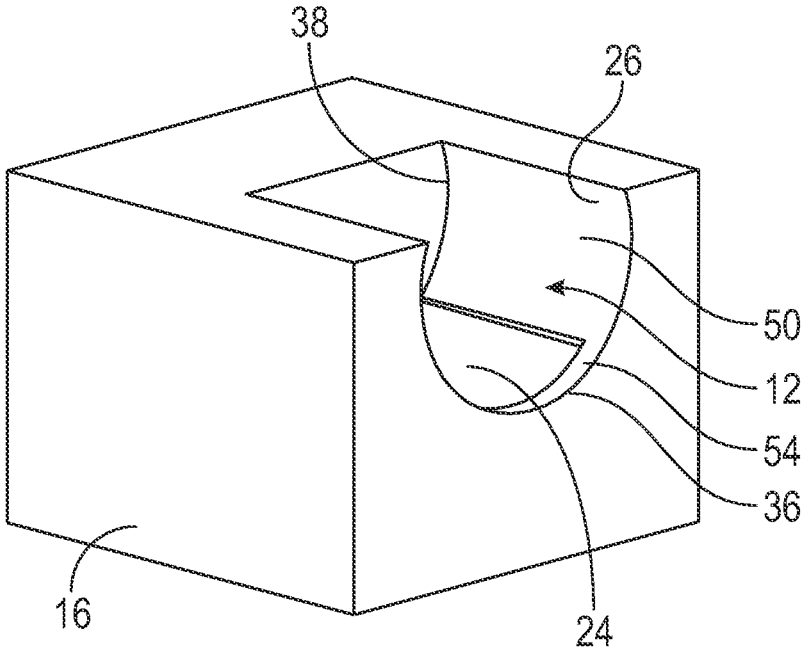
FIG. 7 is a perspective view of a cutter pocket in accordance with some embodiments of the present disclosure.

FIG. 7 a perspective view of a body 16 having a cutter pocket 12 formed therein in accordance with additional embodiments of the present disclosure. The cutter pocket 12 may have features formed in the inner profile 26 to selectively increase the thickness of the braze layer. For example, the inner profile 26 may include a recess 24 comprising an annular groove that is ramped. The recess 24 is radially protruding into the body 16 and extends an axial length, for example, of between 5% to 90% of the overall length of the cutter pocket 12. The recess 24 in this example is formed in the bottom surface 50 extends to the pocket back 38. However, in other embodiments, the recess 24 may terminate before the pocket back 38. In addition, the recess 24 in this example does not extend all the way to the pocket front 36, but instead terminates at a front lip 54 formed at the pocket front 36. In addition, the recess 24 extends only partially around the inner profile 26. However, in other embodiments, the recess 24 may extend around the full circumference of the inner profile 26.

Figure 8:
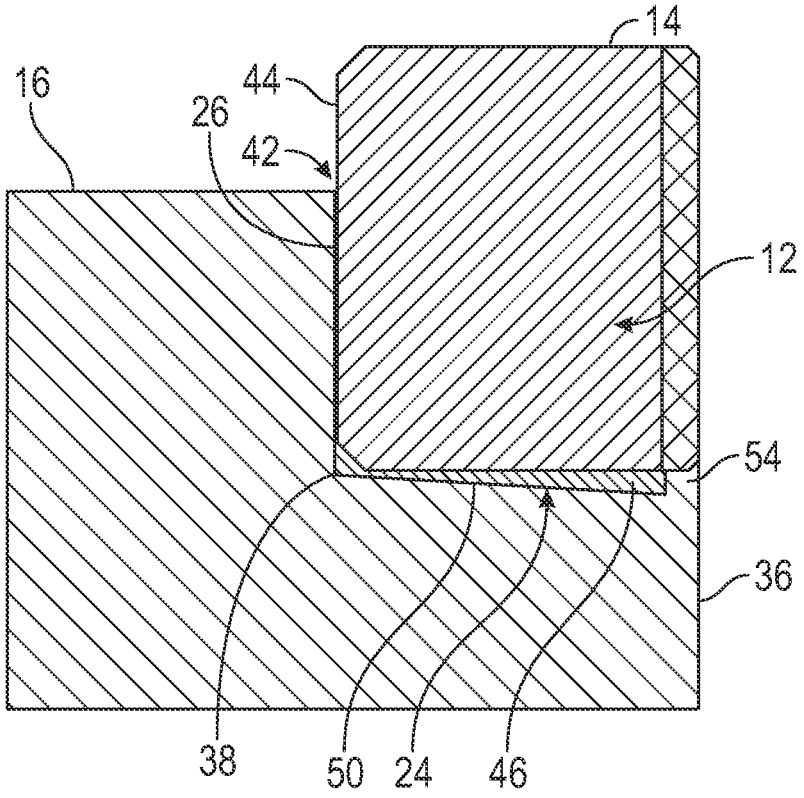
FIG. 8 is a cross-sectional side view of the cutter pocket of FIG. 7 with a cutter mounted in the cutter pocket in accordance with some embodiments of the present disclosure.

FIG. 8 illustrates a cutter 14 installed in a cutter pocket 12 in accordance with some embodiments. The cutter pocket 12 may have similar attributes as the cutter pocket 12 in FIG. 7. For example, the cutter pocket 12 includes a recess 24 in the inner profile 26 to selectively increase the thickness of the braze layer. The bottom surface 50 in this example tapers from the pocket front 36 to the pocket back 38. The back surface 48 in this example is formed in the bottom surface 50. As illustrated, the recess 24 tapers as it extends from the front lip 54 to the pocket back 38, thus creating additional increase in the thickness of the braze layer. A gap or recess 42 comprising an annular groove exists between the outer profile 44 of the cutter 14, and the inner profile 26 of the cutter pocket 12 into which the cutter 14 is to be received. A braze material (i.e., a "braze) 46 is a material, e.g., a braze alloy, used to secure the cutter 14 into the cutter pocket 12. The braze 46 may fill the entire space between the outer profile 44 of the substrate 20 and the inner profile 26 of the cutter pocket 26 with the braze 46 have a thickness that gradually decreases along the taper of the recess as it extends to the pocket back 38.

Figure 9:
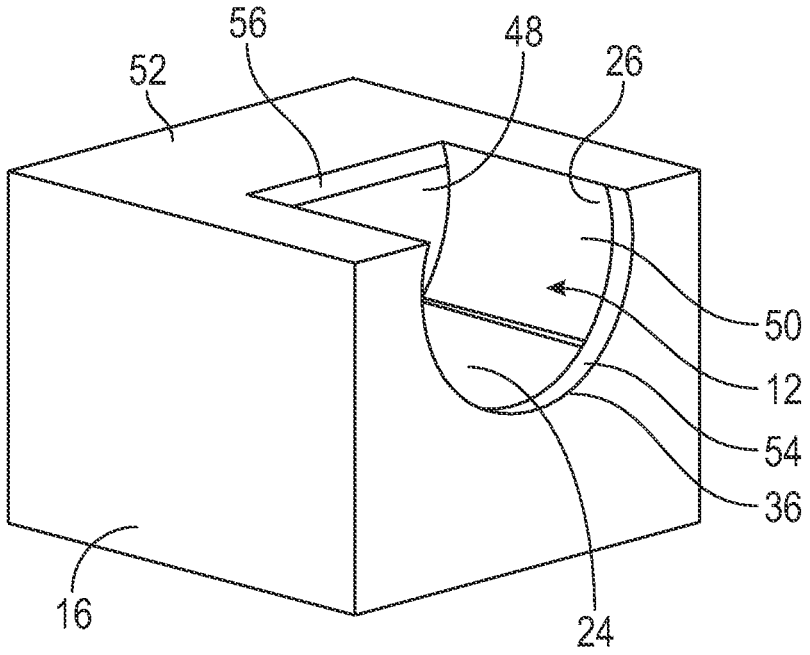
FIG. 9 is a perspective view of a cutter pocket in accordance with some embodiments of the present disclosure.

FIG. 9 a perspective view of a body 16 having a cutter pocket 12 formed therein in accordance with additional embodiments of the present disclosure. The cutter pocket 12 may have features formed in the inner profile 26 to selectively increase the thickness of the braze layer. For example, the inner profile 26 may include a recess 24 (similar to the recess on FIG. 7) comprising an annular groove that is ramped. The recess 24 in this example is formed in the bottom surface 50 extends from a front lip 54 to the pocket back 38. In contrast to the embodiment of FIG. 7, the front lip 54 extends the full circumference of the bottom surface 50, for example, to provide protection to the braze layer (e.g., braze 30 on FIG. 8). The cutter pocket also includes a back surface 48 with a back lip 56 at the pocket top 52. The back lip 56 also extends along the entire back surface 48 at the pocket top 52, for example, to also provide protection to the braze layer.

Figure 10:
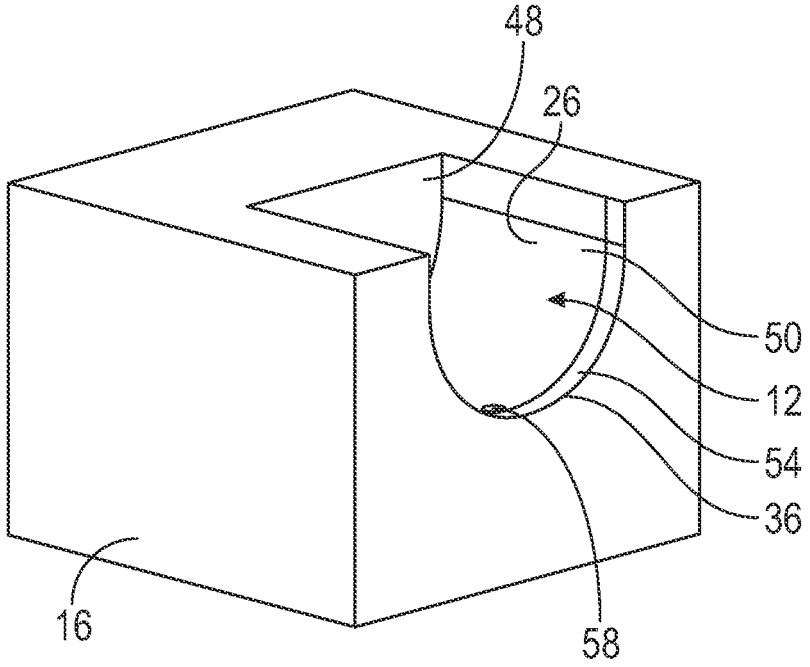
FIG. 10 is a perspective view of a cutter pocket in accordance with some embodiments of the present disclosure.

FIG. 10 a perspective view of a body 16 having a cutter pocket 12 formed therein in accordance with additional embodiments of the present disclosure. The cutter pocket 12 may have features formed in the inner profile 26 to selectively increase the thickness of the braze layer. For example, the inner profile 26 may include a spacer 58 that extends front the inner profile. The spacer 58 have any suitable form, including, for example, a pin, block, rib, or other suitable member that extends from the inner profile 26. The spacer 58 be formed from any suitable material, including, for example, steel or carbide. In the illustrated embodiment, the spacer 58 is positioned in the bottom surface 50 of the inner profile 26 and extends outwardly into the cutter pocket 12. The inner profile 26 also includes a front lip 54 that extends, for example, the full circumference of the bottom surface 50. The spacer 58 in this example is positioned proximate the pocket front 36, but in other examples the for example, within 0.005 inches to 0.5 inches (0.127 mm to 12.7 mm), but the spacer 58 may be otherwise positioned on the bottom surface 50, for example, closer to the back surface 48.

Figure 11:
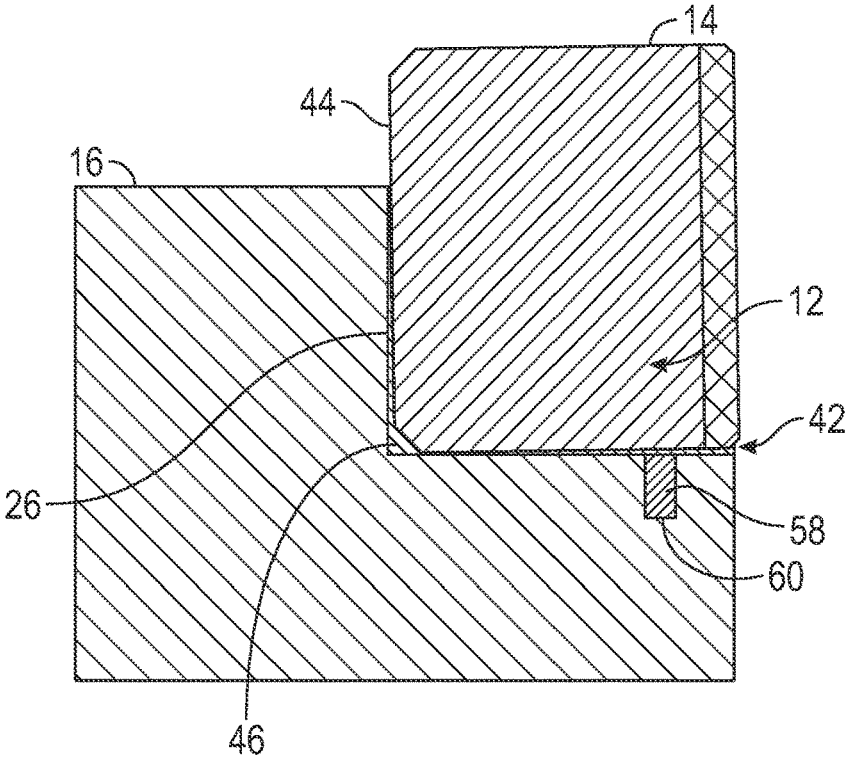
FIG. 11 is a cross-sectional side view of the cutter pocket of FIG. 10 with a cutter mounted in the cutter pocket in accordance with some embodiments of the present disclosure.

FIG. 11 illustrates a cutter 14 installed in a cutter pocket 12 in accordance with some embodiments. The cutter pocket 12 may have similar attributes as the cutter pocket 12 in FIG. 10. For example, the cutter pocket 12 includes a spacer 58 to selectively increase the thickness of the braze layer. The spacer 58 in this example is set in a spacer pocket 60 formed in the bottom surface 50. The spacer 58 may be secured to the body 16 as shown in this example, or the spacer 58 may alternatively be integrally formed with the body 16. A gap or recess 42 comprising an annular groove exists between the outer profile 44 of the cutter 14, and the inner profile 26 of the cutter pocket 12 into which the cutter 14 is to be received. A braze material (i.e., a "braze) 46 is a material, e.g., a braze alloy, used to secure the cutter 14 into the cutter pocket 12. The braze 46 may fill the entire space between the outer profile 44 of the substrate 20 and the inner profile 26 of the cutter pocket 26 with the braze 46. As illustrated, the spacer 58 may selectively increase the thickness of the braze 46 in the gap 42. For example, the spacer 58 may hold a portion of the cutter 14 away from the inner profile 26 to provide to increase the size of the gap 46.

Figure 12:
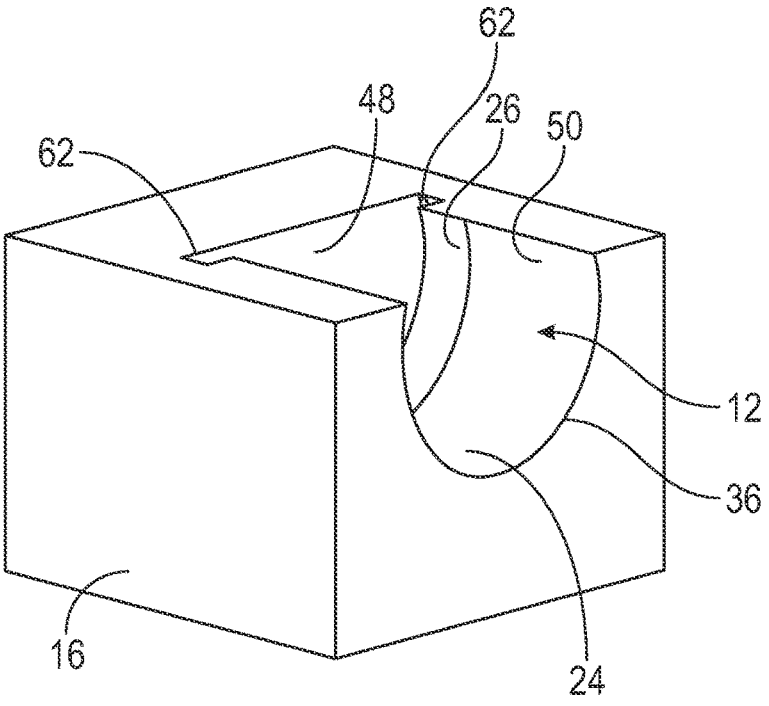
FIG. 12 is a perspective view of a cutter pocket in accordance with some embodiments of the present disclosure.

FIG. 12 a perspective view of a body 16 having a cutter pocket 12 formed therein in accordance with additional embodiments of the present disclosure. The cutter pocket 12 may have features formed in the inner profile 26 to selectively increase the thickness of the braze layer. For example, the inner profile 26 may include a recess 24 comprising an annular groove that is ramped. The recess 24 in the illustrated example is formed in the bottom surface 50 and extends axially a length of the cutter pocket 12. The recess 24 in the illustrated example extends to the pocket front 36, but in other examples may terminate before the pocket front. In addition, the recess 24 in the illustrated example terminates before the back surface 50, but may extend all the way to the back surface 50 in other examples. Even further, the recess 24 is shown extending around the entire circumference of the inner profile 26 but may extend only partially around the inner profile 26 in other embodiments. In addition to the recess 24, the cutter pocket 12 may further includes a groove 62. While the groove 62 is shown being used with the recess 24, it should be understood that the groove 62 and the recess 24 may be used separately or in combination with one another to selectively increase the thickness of the braze layer as desired for a particular application. In the illustrated embodiment, the groove 62 is formed in the bottom surface 50 at the back surface 48. As illustrated, the groove 62 may extend around the full circumference of the inner profile 26 but may extend only partially around the inner profile 26 in other embodiments. In addition, while the groove 62 is shown at the back surface 48, the groove may otherwise be positioned on the bottom surface 50, for example, closer to the pocket front 36. The groove 62 may have any suitable depth, for example, a depth of 0.001 inches to 0.1 inches (0.0254 mm to 2.54 mm).

Figure 13:
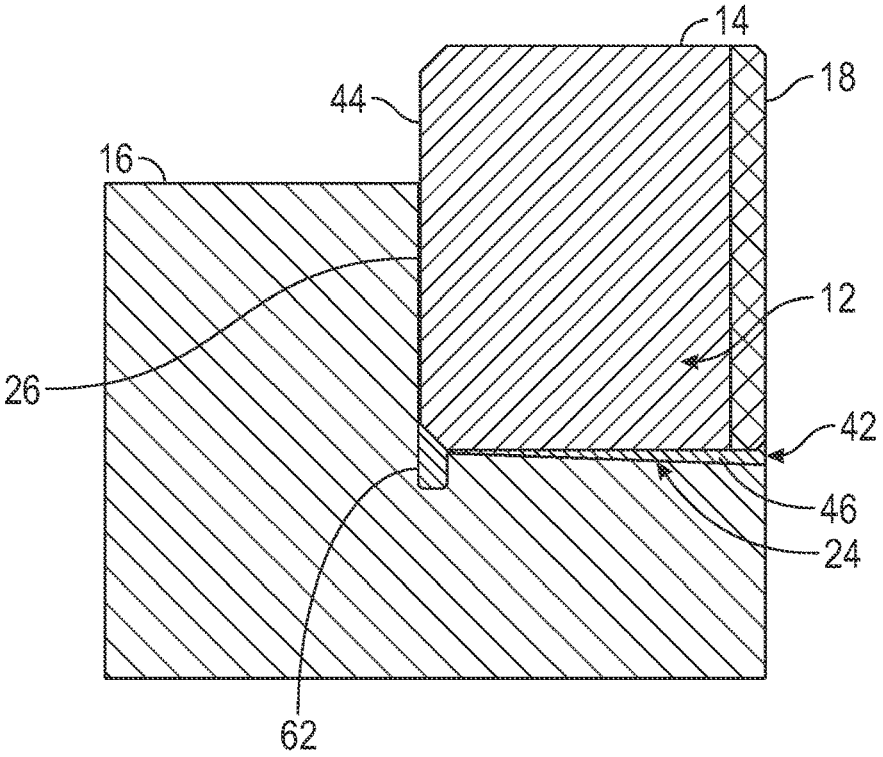
FIG. 13 is a cross-sectional side view of the cutter pocket of FIG. 12 with a cutter mounted in the cutter pocket in accordance with some embodiments of the present disclosure.

FIG. 13 illustrates a cutter 14 installed in a cutter pocket 12 in accordance with some embodiments. The cutter pocket 12 may have similar attributes as the cutter pocket 12 in FIG. 12. For example, the cutter pocket 12 includes a recess 24 that is ramped to selectively increase the thickness of the braze layer. By way of further example, the cutter pocket 12 further includes a groove 62 to also selectively increase the thickness of the braze layer. A gap or recess 42 comprising an annular groove exists between the outer profile 44 of the cutter 14, and the inner profile 26 of the cutter pocket 12 into which the cutter 14 is to be received. A braze material (i.e., a "braze) 46 is a material, e.g., a braze alloy, used to secure the cutter 14 into the cutter pocket 12. The braze 46 may fill the entire space between the outer profile 44 of the substrate 20 and the inner profile 26 of the cutter pocket 26 with the braze 46. As illustrated, the recess 24 and the groove 62 may selectively increase the thickness of the braze 46 in the gap 42. For example, the recess 24 may provide for increased thickness of the braze 46 along the ramp while the groove 24 provide increased areas for the braze 46.

Figure 14:
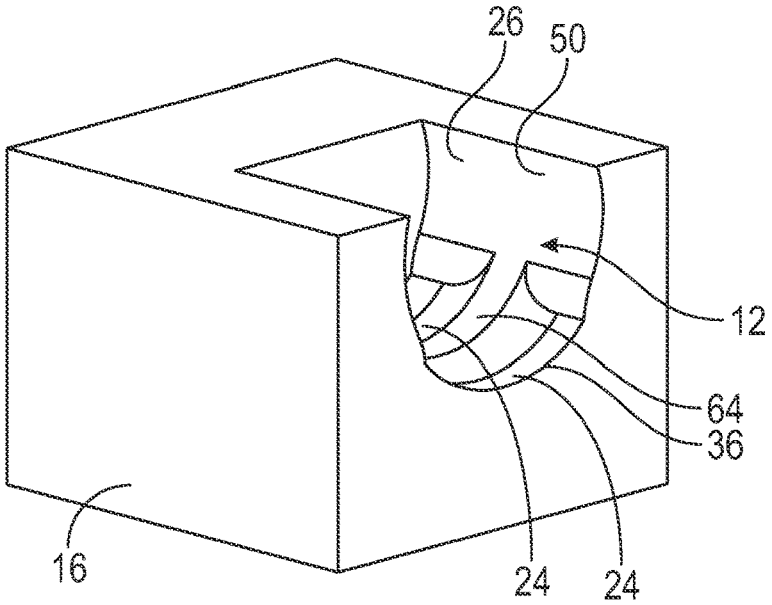
FIG. 14 is a perspective view of a cutter pocket in accordance with some embodiments of the present disclosure.

FIG. 14 a perspective view of a body 16 having a cutter pocket 12 formed therein in accordance with additional embodiments of the present disclosure. The cutter pocket 12 may have features formed in the inner profile 26 to selectively increase the thickness of the braze layer. For example, the inner profile 26 may include a plurality of recesses 24 that are axially spaced. As illustrated, the recesses 24 may be formed in the bottom surface 50 of the inner profile 26. The recesses 24 do not extend along the entire circumference of the bottom surface 50 in this example but may extend along the entire circumference in other examples. While this example shows the recesses 24 being axially spaced, the recesses 24 may otherwise configured, for example, circumferentially spaced. The recesses 24 may have any suitable depth, for example, a depth of 0.001 inches to 0.125 inches (0.0254 mm to 3.175 mm). Even further while the recesses 24 are positioned on either side of a central member 64, the recesses may be otherwise spaced, for example, irregular spacing or both positioned closer to the pocket front 36.

Figure 15:
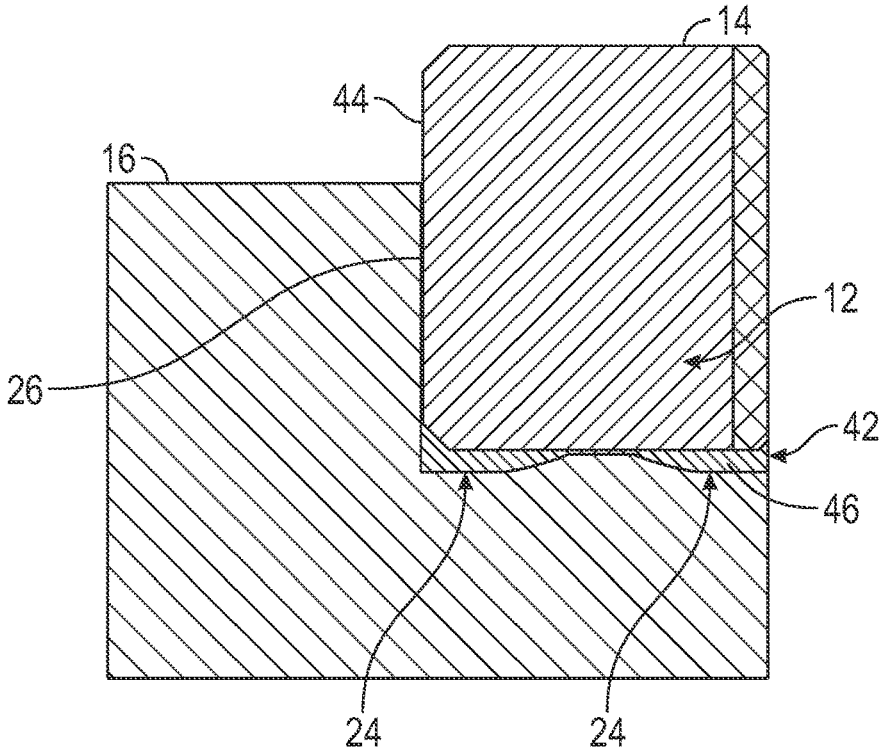
FIG. 15 is a cross-sectional side view of the cutter pocket of FIG. 14 with a cutter mounted in the cutter pocket in accordance with some embodiments of the present disclosure.

FIG. 15 illustrates a cutter 14 installed in a cutter pocket 12 in accordance with some embodiments. The cutter pocket 12 may have similar attributes as the cutter pocket 12 in FIG. 14. For example, the cutter pocket 12 includes a plurality of recesses 24 that are axially spaced to selectively increase the thickness of the braze layer. A gap or recess 42 comprising an annular groove exists between the outer profile 44 of the cutter 14, and the inner profile 26 of the cutter pocket 12 into which the cutter 14 is to be received. A braze material (i.e., a "braze) 46 is a material, e.g., a braze alloy, used to secure the cutter 14 into the cutter pocket 12. The braze 46 may fill the entire space between the outer profile 44 of the substrate 20 and the inner profile 26 of the cutter pocket 26 with the braze 46. As illustrated, the recesses 26 may selectively increase the thickness of the braze 46 in the gap 42, for example, by providing a region of increased thickness.

Figure 16:
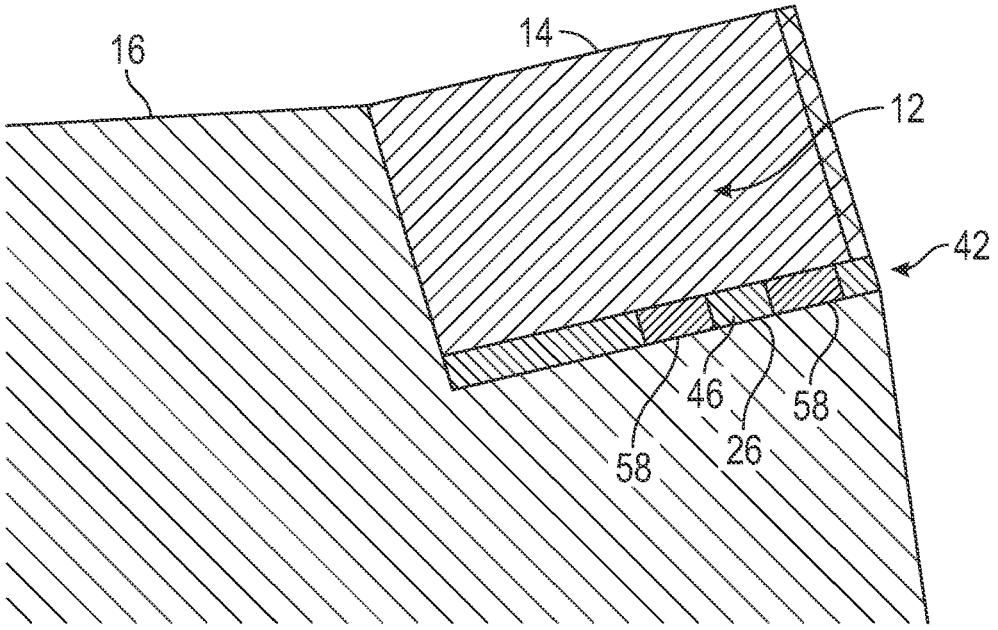
FIG. 16 is a cross-sectional side view a cutter pocket with a cutter mounted in the cutter pocket in accordance with some embodiments of the present disclosure.

FIG. 16 illustrates a cutter 14 installed in a cutter pocket 12 in accordance with some embodiments. The cutter pocket 12 may have features formed in the inner profile 26 to selectively increase the thickness of the braze layer. For example, the inner profile 26 may include a plurality of spacers 58. The spacer 58 have any suitable form, including, for example, a pin, block, rib, or other suitable member that extends from the inner profile 26. The spacer 58 be formed from any suitable material, including, for example, steel or carbide. The spacer 58 may be secured to the body 16 as shown in this example, or the spacer 58 may alternatively be integrally formed with the body 16. A gap or recess 42 comprising an annular groove exists between the outer profile 44 of the cutter 14, and the inner profile 26 of the cutter pocket 12 into which the cutter 14 is to be received. A braze material (i.e., a "braze) 46 is a material, e.g., a braze alloy, used to secure the cutter 14 into the cutter pocket 12. The braze 46 may fill the entire space between the outer profile 44 of the substrate 20 and the inner profile 26 of the cutter pocket 26 with the braze 46. As illustrated, the spacer 58 may selectively increase the thickness of the braze 46 in the gap 42. For example, the spacer 58 may hold a portion of the cutter 14 away from the inner profile 26 to provide to increase the size of the gap 46.

Figure 17:
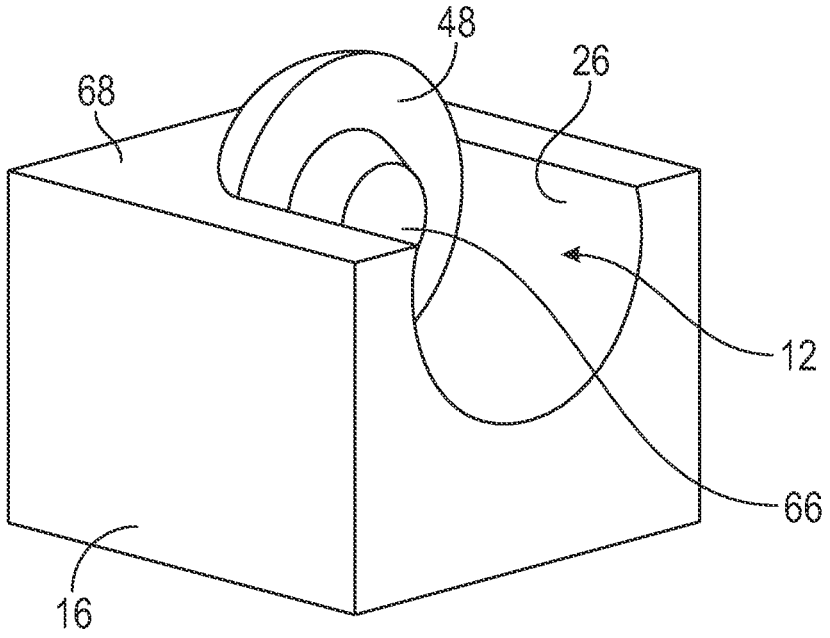
FIG. 17 is a perspective view of a cutter pocket in accordance with some embodiments of the present disclosure.

FIG. 17 is a perspective view of a body 16 having a cutter pocket 12 formed therein in accordance with additional embodiments of the present disclosure. The cutter pocket 12 may have features formed in the inner profile 26 to selectively increase the thickness of the braze layer. For example, the inner profile 26 may include a pocket protrusion 66 formed in the back surface 48. The back surface 48 may also extend from a side 68 of the body 16. While the pocket protrusion 66 is shown being centrally positioned on the back surface 48, the pocket protrusion 66 may be otherwise positioned on the back surface 48.

Figure 18:
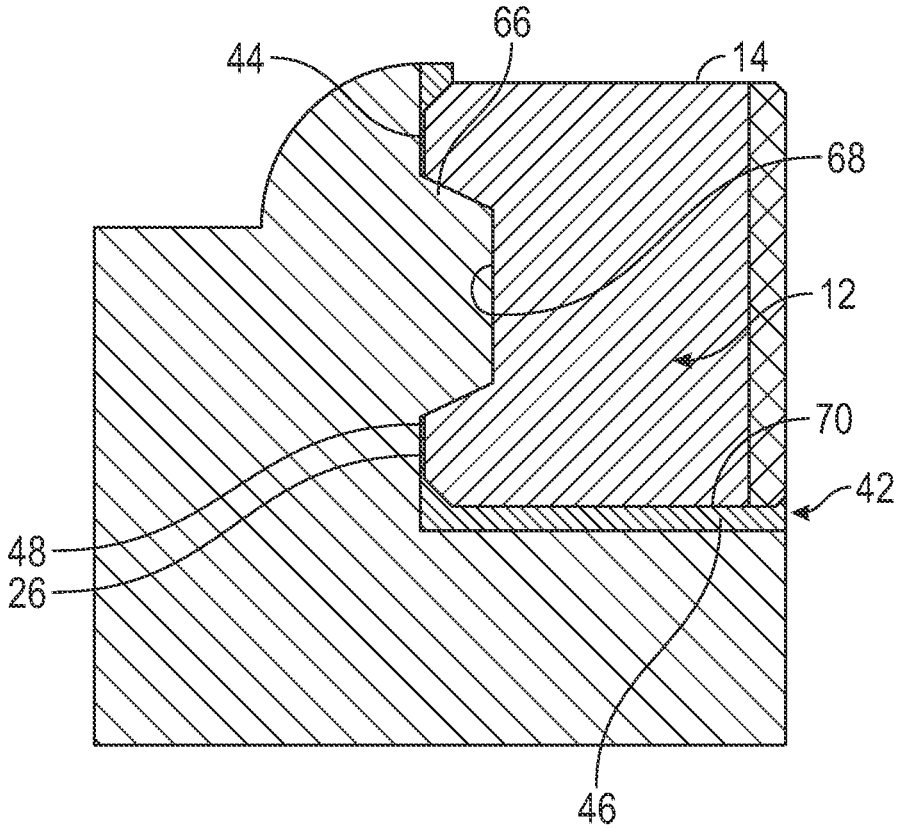
FIG. 18 is a cross-sectional side view of the cutter pocket of FIG. 17 with a cutter mounted in the cutter pocket in accordance with some embodiments of the present disclosure.

FIG. 18 illustrates a cutter 14 installed in a cutter pocket 12 in accordance with some embodiments. The cutter pocket 12 may have features formed in the inner profile 26 to selectively increase the thickness of the braze layer. For example, a pocket protrusion 66 is formed on the inner profile 26 of the cutter pocket 12 at the back surface 48. As illustrated, a cutter 14 may be received in the cutter pocket 12. The inner profile 44 of the cutter 14 have a cutter recess 68. A gap or recess 42 comprising an annular groove exists between the outer profile 44 of the cutter 14, and the inner profile 26 of the cutter pocket 12 into which the cutter 14 is to be received. A braze material (i.e., a "braze) 46 is a material, e.g., a braze alloy, used to secure the cutter 14 into the cutter pocket 12. The braze 46 may fill the entire space between the outer profile 18 of the cutter 14 and the inner profile 26 of the cutter pocket 12. The outer profile 18 and inner profile 26 are generally shaped to conform to one another. In the illustrated embodiment, the gap 42 is not thicker at the pocket protrusion 66. However, the cutter recess 68 receives the pocket protrusion 66 to hold the cutter 14 in the cutter pocket 12 such that the portion of the gap 42 between a side 70 of the cutter 14 and the inner profile 26 of the cutter pocket 12 is increased, thus increasing the thickness of the braze 30 at that location.

Figure 19:
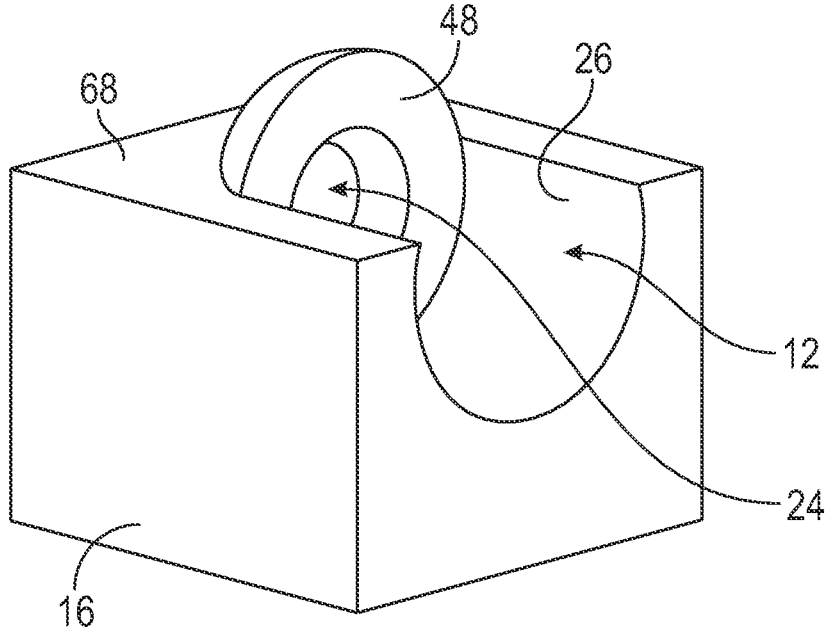
FIG. 19 is a perspective view of a cutter pocket in accordance with some embodiments of the present disclosure.

FIG. 19 is a perspective view of a body 16 having a cutter pocket 12 formed therein in accordance with additional embodiments of the present disclosure. The cutter pocket 12 may have features formed in the inner profile 26 to selectively increase the thickness of the braze layer. For example, the inner profile 26 may include a recess 24 formed in the back surface 48. The back surface 48 may also extend from a side 68 of the body 16. While the recess 24 is shown being centrally positioned on the back surface 48, the recess 24 may be otherwise positioned on the back surface 48.

Figure 20:
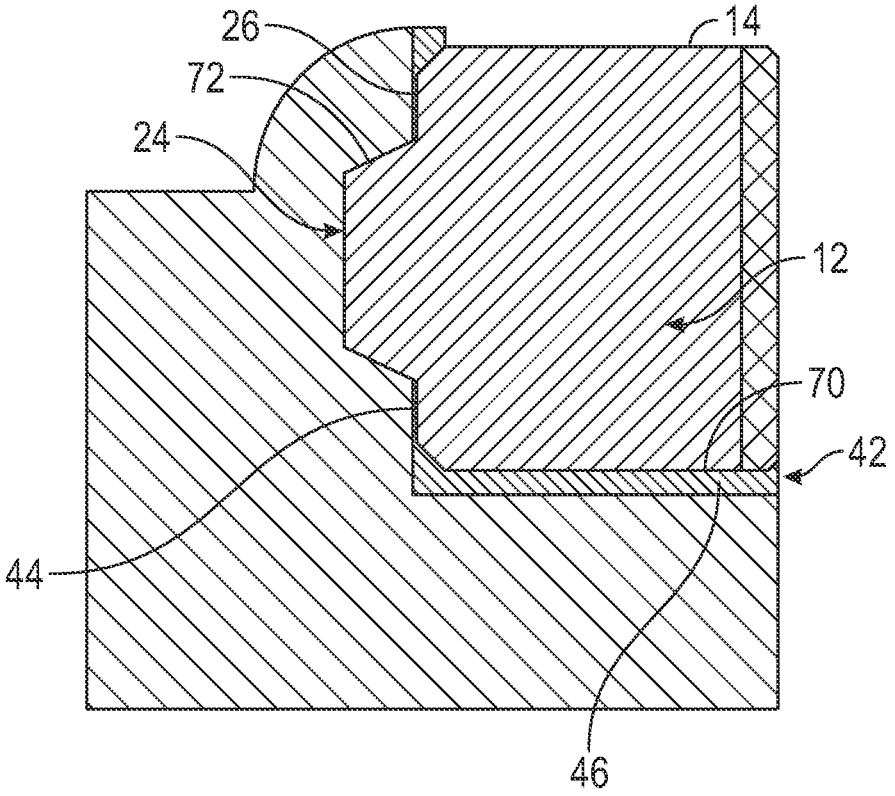
FIG. 20 is a cross-sectional side view of the cutter pocket of FIG. 19 with a cutter mounted in the cutter pocket in accordance with some embodiments of the present disclosure.

FIG. 20 illustrates a cutter 14 installed in a cutter pocket 12 in accordance with some embodiments. The cutter pocket 12 may have features formed in the inner profile 26 to selectively increase the thickness of the braze layer. For example, a recess 24 is formed on the inner profile 26 of the cutter pocket 12 at the back surface 48. As illustrated, a cutter 14 may be received in the cutter pocket 12. The inner profile 44 of the cutter 14 have a back protrusion 72. A gap or recess 42 comprising an annular groove exists between the outer profile 44 of the cutter 14, and the inner profile 26 of the cutter pocket 12 into which the cutter 14 is to be received. A braze material (i.e., a "braze) 46 is a material, e.g., a braze alloy, used to secure the cutter 14 into the cutter pocket 12. The braze 46 may fill the entire space between the outer profile 18 of the cutter 14 and the inner profile 26 of the cutter pocket 12. The outer profile 18 and inner profile 26 are generally shaped to conform to one another. In the illustrated embodiment, the gap 42 is not thicker at the recess 24. However, the recess 24 receives the back protrusion 72 on the cutter 14 to hold the cutter 14 in the cutter pocket 12 such that the portion of the gap 42 between a side 70 of the cutter 14 and the inner profile 26 of the cutter pocket 12 is increased, thus increasing the thickness of the braze 30 at that location.

Figure 21:
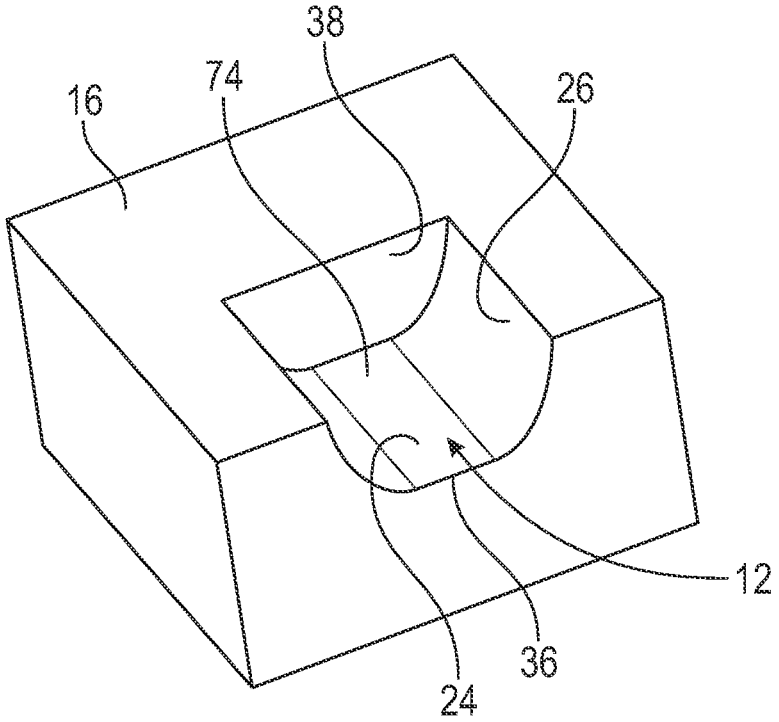
FIG. 21 is a perspective view of a cutter pocket in accordance with some embodiments of the present disclosure.

FIG. 21 illustrates a representative body 16, which may be a portion of a bity body, for example, in accordance with some embodiments. As illustrated, a cutter pocket 12 may be formed in the body 16. The cutter pocket 12 may have an inner profile 26. In accordance with example embodiments, the cutter pocket 12 includes one or more features to selectively increase a thickness of a braze layer. For example, a recess 24 comprising an annular groove may be formed in the inner profile 26 of the cutter pocket 12. The recess 24 may provide for an increased gap thickness and, thus, increased thickness of a braze layer. The recess 24 is radially protruding into the body 16 and extends an axial length. The recess 24 in this example extends from a pocket front 36 and to the pocket back 38. However, in other embodiments, the recess 24 may terminate before the pocket back 38 and/or terminate before the pocket front 36. In addition, the recess 24 extends only partially around the inner profile 26. However, in other embodiments, the recess 24 may extend around the full circumference of the inner profile 26. Even further, the recess 24 includes a recess profile 74 that is flat, but, in other embodiments, the recess profile 74 may be curved.

Figure 22:
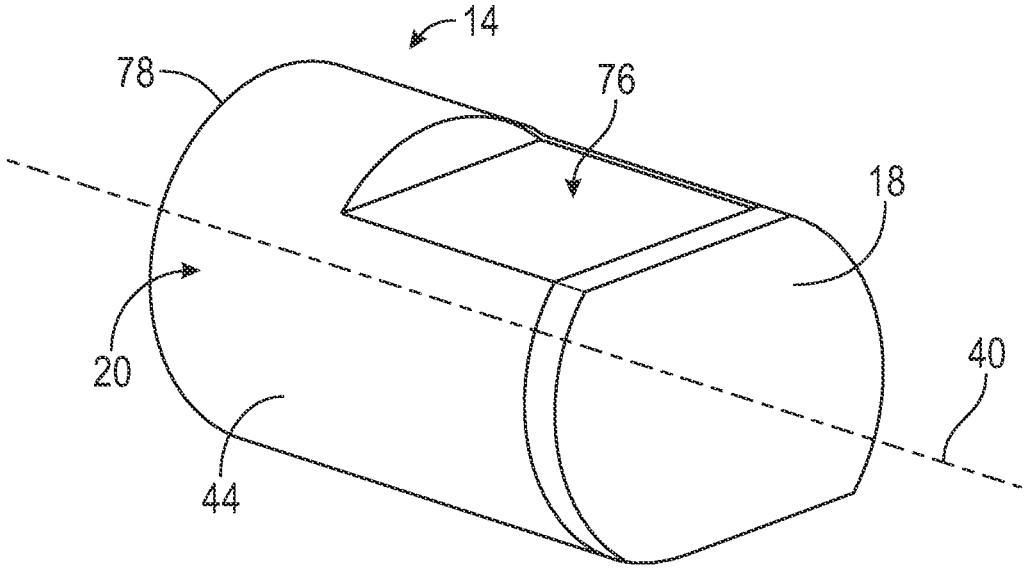
FIG. 22 is a perspective view for cutter for positioning in the cutter pocket of FIG. 21 in accordance with some embodiments of the present disclosure.

FIG. 22 illustrates a cutter 14 that may be used, for example, with the cutter pocket 12 of FIG. 21. As illustrated, the cutter 14 has a cutting table 18 secured to a substrate 20. In the illustrated embodiment, the cutter 14 includes a cutter recess 76. For example, the cutter recess 76 comprises an annular groove formed in the outer profile 44 of the substrate 20. The cutter recess 76 is radially protruding into the substrate 20 and extends an axial length along the cutter axis 40. As illustrated, the cutter recess 76 extends at least partially into the cutting table 18. In the illustrated embodiment, the recess 76 extends all the way through the full thickness of the cutting table 18. However, in other embodiments, the recess 76 may terminate before the cutting table 18. As illustrated, the cutter recess 76 terminates before the cutter back end 78. However, in other embodiments, the cutter recess 76 may extends to the cutter back end 78. In addition, the cutter recess 76 extends only partially around the outer profile 44. However, in other embodiments, the cutter recess 76 may extend around the full circumference of the outer profile 44. With additional reference to FIG. 21, the cutter recess 76 on the cutter 14 may cooperate, for example, with the recess 24 of the cutter pocket 12 of FIG. 21, for example, to provide an increased gap thickness between the outer profile 44 of the cutter 14 and the inner profile 26 of the cutter pocket 12, resulting in an increased thickness of the braze layer at that region.

Figure 23:
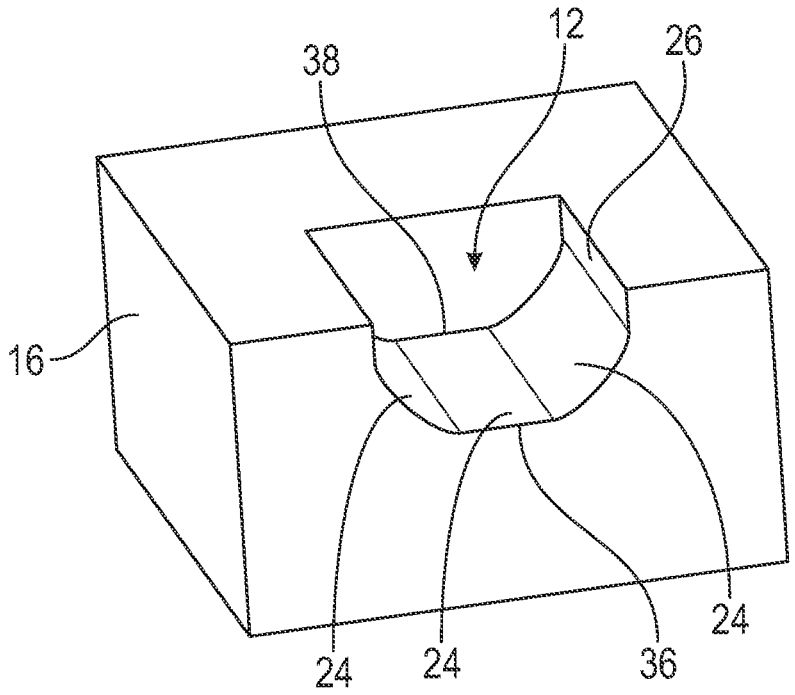
FIG. 23 is a perspective view of a cutter pocket in accordance with some embodiments of the present disclosure.

FIG. 23 illustrates a representative body 16, which may be a portion of a bity body, for example, in accordance with some embodiments. As illustrated, a cutter pocket 12 may be formed in the body 16. The cutter pocket 12 may have an inner profile 26. In accordance with example embodiments, the cutter pocket 12 includes one or more features to selectively increase a thickness of a braze layer. For example, a plurality of recesses 24 comprising an annular groove may be formed in the inner profile 26 of the cutter pocket 12. The recesses 24 may provide for an increased gap thickness and, thus, increased thickness of a braze layer. The recesses 24 are radially protruding into the body 16 and extend an axial length. The recesses 24 in this example extends from a pocket front 36 and to the pocket back 38. However, in other embodiments, the recesses 24 may terminate before the pocket back 38 and/or terminate before the pocket front 36.

Figure 24:
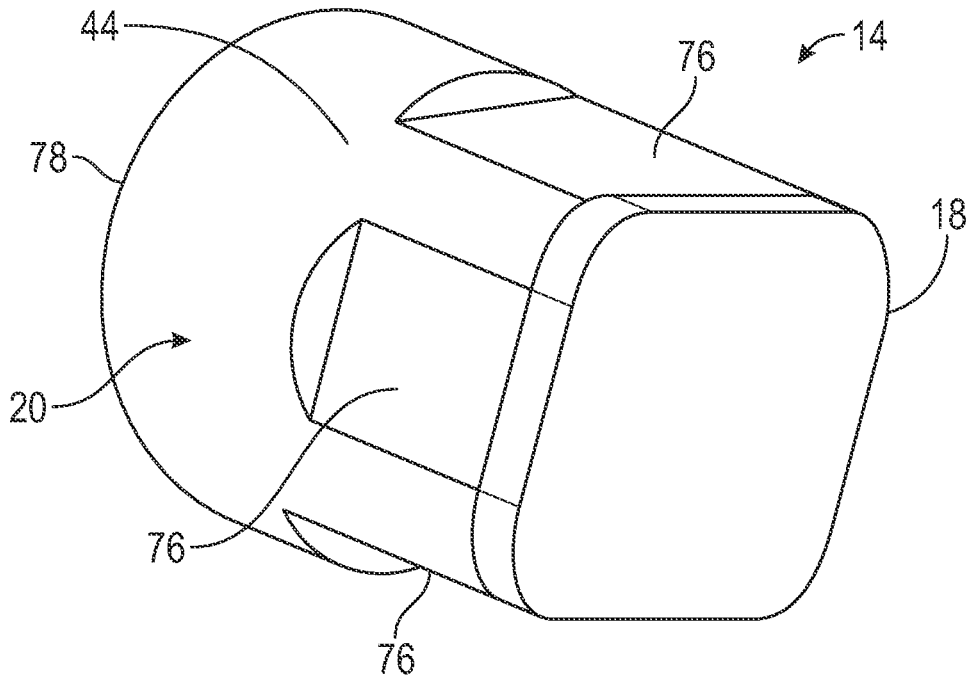
FIG. 24 is a perspective view for cutter for positioning in the cutter pocket of FIG. 23 in accordance with some embodiments of the present disclosure.

FIG. 24 illustrates a cutter 14 that may be used, for example, with the cutter pocket 12 of FIG. 23. As illustrated, the cutter 14 has a cutting table 18 secured to a substrate 20. In the illustrated embodiment, the cutter 14 includes a plurality of cutter recess 76. For example, the cutter recesses 76 each comprise an annular groove formed in the outer profile 44 of the substrate 20. The cutter recesses 76 are radially protruding into the substrate 20 and extend an axial length along the cutter axis 40. As illustrated, the cutter recesses 76 extends at least partially into the cutting table 18. In the illustrated embodiment, the recesses 76 extends all the way through the full thickness of the cutting table 18. However, in other embodiments, the recesses 76 may terminate before the cutting table 18. As illustrated, the cutter recesses 76 terminate before the cutter back end 78. However, in other embodiments, the cutter recess 76 may extends to the cutter back end 78. With additional reference to FIG. 23, the cutter recesses 76 on the cutter 14 may cooperate, for example, with the recesses 24 of the cutter pocket 12 of FIG. 23, for example, to provide an increased gap thickness between the outer profile 44 of the cutter 14 and the inner profile 26 of the cutter pocket 12, resulting in an increased thickness of the braze layer at that region.

Figure 25:
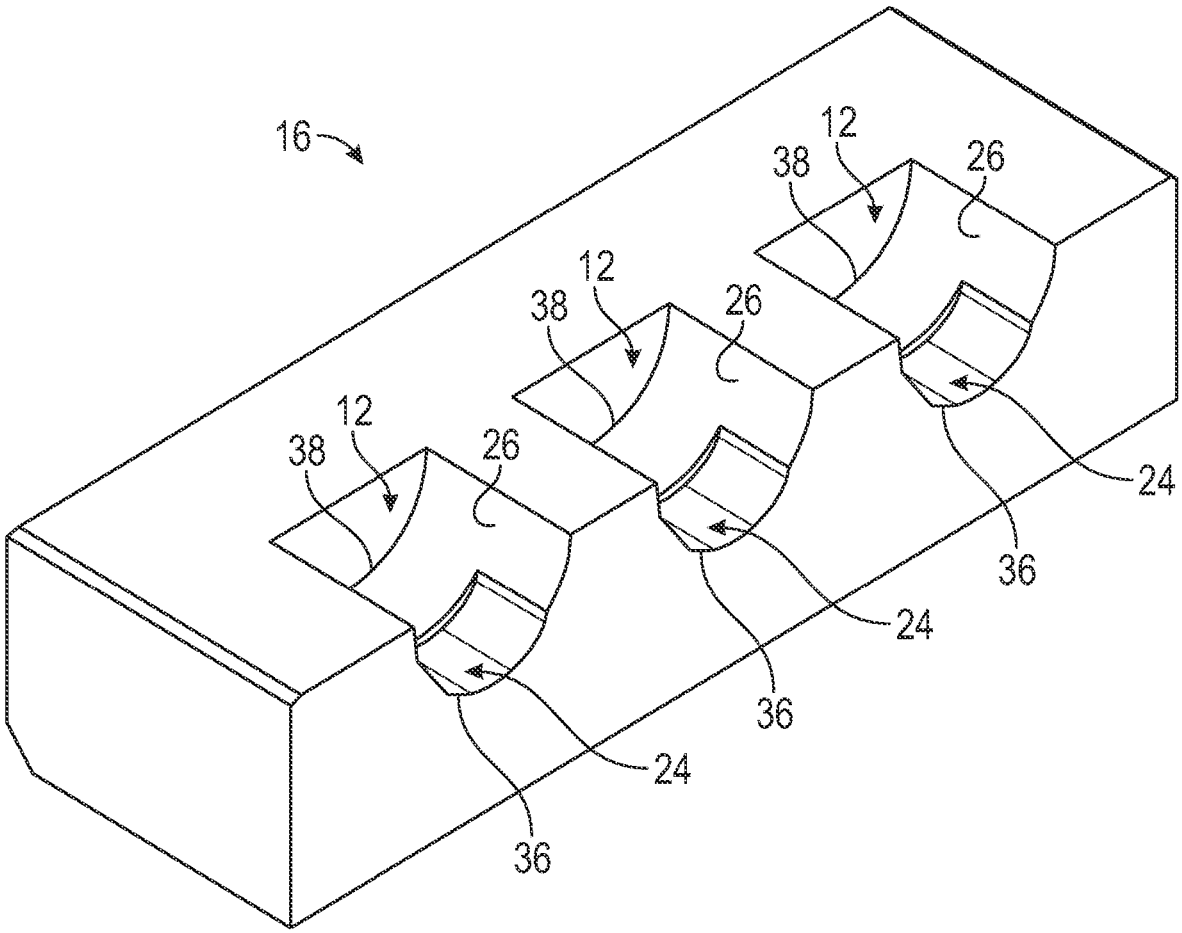
FIG. 25 is a perspective view of multiple cutter pockets in accordance with some embodiments of the present disclosure.

FIG. 25 illustrates a representative body 16, which may be a portion of a bity body, for example, in accordance with some embodiments. As illustrated, a plurality of cutter pockets 12 may be formed in the body 16. The cutter pockets 12 may each have an inner profile 26. In accordance with example embodiments, the cutter pockets 12 each include one or more features to selectively increase a thickness of a braze layer. For example, a recess 24 comprising an annular groove may be formed in the inner profile 26 of each of the cutter pockets 12. The recesses 24 may provide for an increased gap thickness and, thus, increased thickness of a braze layer. The recesses 24 are radially protruding into the body 16 and extend an axial length. The recesses 24 in this example extends from a pocket front 36 and terminated before the pocket back 38. However, in other embodiments, the recesses 24 may extend to the pocket back 38 and/or terminate before the pocket front 36. In addition, the recesses 24 extends only partially around the inner profiles 26. However, in other embodiments, the recesses 24 may extend around the full circumference of the inner profiles 26.

Figure 26:
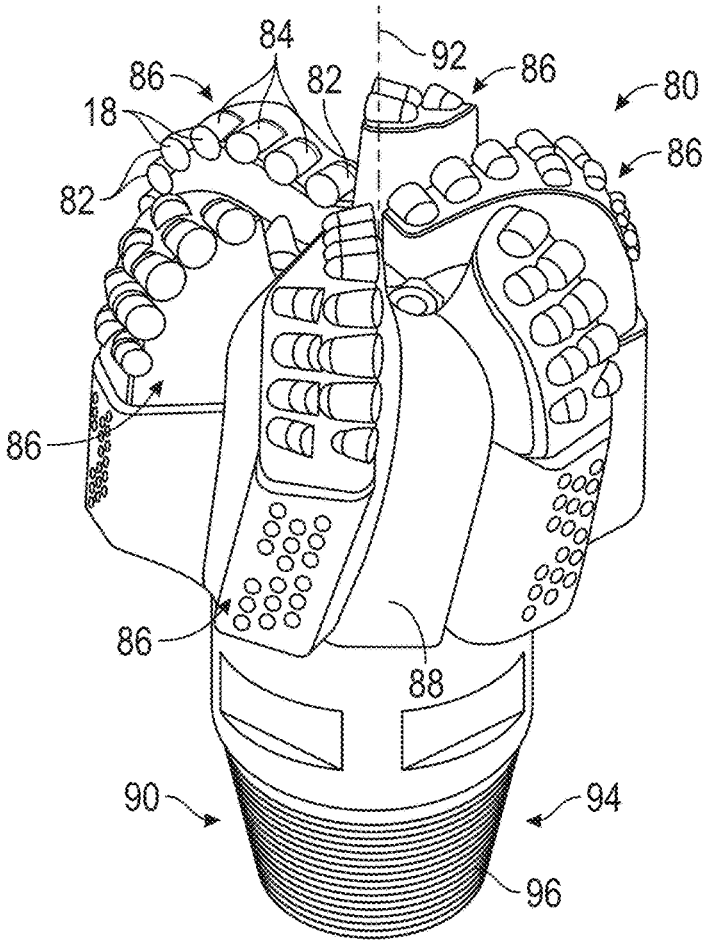
FIG. 26 is an isometric view of a fixed cutter drill bit in accordance with some embodiments of the present disclosure.

FIG. 26 illustrates a fixed cutter drill bit 80 according to an example configuration that may have stress reducing features at the braze joint between one or more cutters and cutter pockets. The drill bit 80 includes a plurality of fixed cutters (e.g., round cutters, shaped cutters, and/or other fixed cutters) positioned by virtue of their orientations on the bit body to directly engage an earthen formation when drilling. The fixed cutters in this example include round cutters 82. The fixed cutters optionally also include non-round, alternately referred to as "shaped" cutters 84 in reference to the shaped diamond tables external to the cutter pockets, which may be a separate issue from the shape of the braze joint internal to the cutter pockets according to this disclosure. The drill bit 80 is oriented upwardly in FIG. 26 for purpose of illustration, such as to show the arrangement of blades 86, round cutters 82, and shaped cutters 84. The drill bit 80 in this example has six blades 86 disposed outwardly from a rotary bit body 88. Generally, blades formed in accordance with teachings of the present disclosure may have any of a wide variety of configurations including, but not limited to, substantially arched, helical, spiraling, tapered, converging, diverging, symmetrical, and/or asymmetrical.

The round cutters 82 and shaped cutters 84 are secured along the blades 86 at fixed positions and orientations, which placement may be one of the design parameters according to this disclosure. Each of the round cutters 82 and shaped cutters 84 may be placed on the drill bit 80 for a particular purpose, including but not limited to intended use as primary cutters, backup cutters, secondary cutters, gage cutters, and so forth, according to a particular drilling application. Each of the round cutters 82 and shaped cutters 84 may be directly or indirectly coupled to an exterior portion of the respective blade 86. For example, the round cutters 82 and shaped cutters 84 may be retained in recesses or cutter pockets located on blades 86 of drill bit 480 with a brazing material, welding material, soldering material, adhesive, or other attachment material. As previously described, one or more of the round cutters 54 and shaped cutters 56 may include features to improve the brazing interface. For example, one or more of the cutter pockets (e.g., cutter pocket 12 described herein) may include features to selectively increase a thickness of a brazing layer. Although not required, one or more rolling cutter may also be mounted in rolling cutter pockets on the blade 86 allowing the cutter to independently rotate within the rolling cutter pocket about its own cutter axis. With the exception of any rolling cutters, however, the round cutters 82 and shaped cutters 84 are fixed cutters that are not permitted to rotate about their cutter axes. The shaped cutters 84, in particular, may be secured to the bit body 88 at a fixed rotational position about their respective cutter axes to improve their performance and the overall bit performance as further detailed below.

The drill bit 80 includes a connector 90 for coupling the drill bit 80 to a drill string. A method of drilling may comprise rotating the drill bit 80 about the bit axis 92 while engaging a formation with the cutters to cut, crush, shear, gouge, abrade, or otherwise disintegrate the formation. A drilling fluid may be circulated downhole through the drill string and drill bit 80 as generally understood in the art apart from the teachings of this disclosure. The connector 90 may comprise any suitable connector for a drill bit, as generally understood in the art apart from the specific teachings of this disclosure, some examples of which may be prescribed by a standards body such as American Petroleum Institute (API) based on the bit type, size, drilling application, and other factors. See, e.g., API Specification 7—Specification for Rotary Drill Stem Elements. The connector 90 is embodied by way of example here as a shank 94 with drill pipe threads 96 formed thereon. The threads 96 may be used to threadedly connect with corresponding threads on another drill string component to releasably engage the drill bit 80 with a bottom hole assembly included in the drill string. Typically, the bit axis 92 will be aligned with (e.g., co-axial) with an axis of the drill string, although in specific applications like directional drilling the bit axis 92 may be deviated slightly with respect to the axis of the drill string. When coupled to the drill string, the drill bit 80 may be rotated around the bit axis 92 (and/or the axis of the drill string), such as by rotation of the whole drill string or by rotation of the drill bit 80 with respect to other parts of the drill string with a downhole motor in the bottomhole assembly ("BHA"). Each of the round cutters 82 and shaped cutters 84 may include a respective cutting element 18 that is positioned to engage a downhole formation to drill a wellbore by rotation of the drill bit 80.

The drill bit 80 may be designed and manufactured in accordance with teachings of the present disclosure to improve aspects of bit performance or specifically cutter performance by incorporating stress reducing features according to this disclosure. Bit performance and/or cutter performance can be characterized in terms of performance parameters, such as drilling speed and efficiency, rate of penetration, revolutions per minute (RPM), weight on bit (WOB), borehole diameter and quality, durability, force balancing, stick-slip reduction, and cutter wear, such as uniformity of cutter wear on shaped cutters, to list just some examples. Drill bit design parameters may be any aspect of the drill bit design that affects bit performance. Some drill bit design parameters affecting bit performance are specifically related to the cutters, including but not limited to cutter type, cutter shape, the number of cutters, their spacing, position, and orientation, and also the configurations of the cutter pockets and cutters and the resulting braze interfaces therebetween.

A system and method according to the present disclosure may improve drill bit performance relative to some reference (e.g., baseline values) by adjusting one or more bit design parameters including incorporation of stress reducing features (e.g., recesses 24, tapers, spacers 58, and/or pocket protrusions 68 as described herein) at the braze joints to improve cutter performance and longevity. One aspect of this bit design may include generating a detailed computer model of the drill bit configuration including a baseline value of the design parameters and adjusting the design parameters such as to refine the brazing of the round cutters 82 and shaped cutters 84 on the blades 86 of the drill bit 80. A related aspect of bit design may include simulating drilling with the detailed computer model of a bit design to compare bit/cutter performance at a baseline value of the design parameter(s) with adjusted value(s) of the design parameter(s). This method may include simulating interactions between the various fixed cutters (e.g., round cutters 82 and shaped cutters 84) on the drill bit 80 and the geologic formation to determine how the round cutters 82 and shaped cutters 84 will individually and collectively perform in operation. The method may further include modifying the cutter and/or cutter pocket at an interface to improve the braze joint to improve cutter performance relative to a baseline value.

Figure 27:
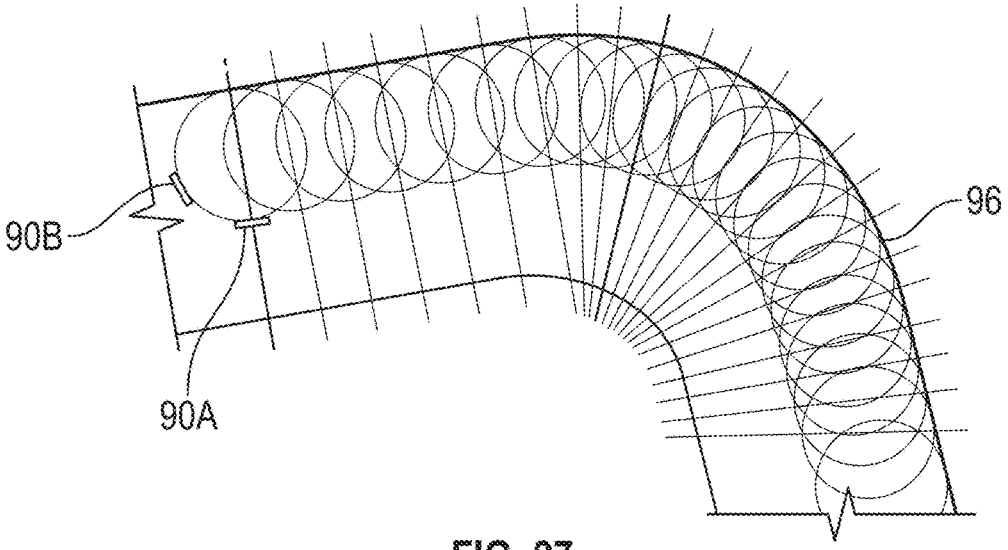
FIG. 27 is a schematic diagram of a cutter profile illustrating in accordance with some embodiments of the present disclosure.

FIG. 27 is a schematic diagram of a cutter profile illustrating some possible locations 90A, 90B of a recess formed on the cutter (e.g., cutter 14) and/or cutter pocket (e.g., cutter pocket 12) at the braze interface. A cutter profile line is generally a reference line defined by the outermost, tangent points of the cutters along a particular blade that in theory may contact the formation being drilled. A cutter tilt axis refers to the reference line through each cutter perpendicular to the cutter profile line. In many cases, the recess on the cutter pocket is intersected by, and may also be oriented perpendicular to, the cutter tilt axis (i.e., parallel to the profile line at that cutter), such as at location 90A. This orientation sees the highest cutter loading from weight on bit. However, radial and drag forces also act on the cutter, and the force distribution varies in differing application. In some applications it may be desirable to orient the recess rotated circumferentially away from the position perpendicular to the cutter tilt line such as at location 90B to account for the increase in radial and drag loadings.

Accordingly, the present disclosure may provide improved longevity of fixed cutter drill bits by improving the brazing interface of the cutters with the cutter pockets of a bit body. The methods, systems, and apparatus may include any of the various features disclosed herein, including one or more of the following statements.

Statement 1. A drill bit, comprising: a bit body defining a rotational axis and having a plurality of cutter pockets formed thereon, each cutter pocket shaped to receive a respective substrate of a cutter; wherein each cutter pocket has an inner profile that defines an area of increased braze gap that conforms to an outer profile of the respective substrate; and a braze interface comprising a braze alloy disposed in each cutter pocket between the inner profile of the cutter pocket and the outer profile of the respective substrate, such that a thickness of the braze alloy is greater at the area of increased braze gap.

Statement 2. The drill bit of statement 1, further comprising a uniform gap between the inner and outer profiles outside the area of increased braze gap.

Statement 3. The drill bit of statement 1 or statement 2, wherein the braze interface includes a region of compression and a region of tension under a drilling loading, and wherein the area of increased braze gap is positioned in the cutter pocket within the region of tension.

Statement 4. The drill bit of any preceding statement, wherein the area of increased braze gap is in a region of the cutter pocket intersected by a cutter tilt axis of that cutter.

Statement 5. The drill bit of any preceding statement, wherein the area of increased braze gap comprises an annular groove defined between the cutter pocket and the substrate.

Statement 6. The drill bit of statement 5, wherein the annular groove has an annular length of less than 180 degrees.

Statement 7. The drill bit of statement 5 or statement 6, wherein the annular groove extends a full 360 degrees.

Statement 8. The drill bit of any preceding statement, wherein the thickness of the braze alloy along the area of increased braze gap is between 0.010 inches and 0.040 inches.

Statement 9. The drill bit of any preceding statement, wherein the area of increased braze gap is in a region of the cutter pocket rotated circumferentially away from perpendicular to the cutter tilt line.

Statement 10. The drill bit of any preceding statement, wherein the area of increased braze gap is defined at least partially by the outer profile of the respective substrate.

Statement 11. The drill bit of any preceding statement, wherein the braze alloy comprises at least one alloy selected from the group consisting of a copper alloy, a nickel alloy, a silver alloy, a gold alloy, and combinations thereof.

Statement 12. A braze joint, comprising: a cutter substrate having an outer profile; a cutter pocket for receiving the cutter substrate and having an inner profile that conforms to the outer profile of the substrate, with an area of increased braze gap defined at least partially by the inner profile of the cutter pocket; and a braze interface comprising a braze alloy disposed in the cutter pocket between the inner profile of the cutter pocket and the outer profile of the cutter substrate, whereby the braze alloy has a greater thickness in the area of increased braze gap.

Statement 13. The braze joint of statement 12, wherein the area of increased braze gap is defined at least partially by the outer profile of the respective substrate.

Statement 14. The braze joint of statement 12 or statement 13, wherein the area of increased braze gap comprises a recess defined by the cutter pocket.

Statement 15. The braze joint of any one of statements 12 to 14, wherein the area of increased braze gap comprises a taper.

Statement 16. A method of designing a drill bit, comprising: determining an expected loading on a plurality of fixed cutters received across a plurality of cutter pockets of a bit body; identifying one or more regions to increase a thickness of a braze interface between a fixed cutter and a corresponding cutter pocket of the plurality of cutter pockets; selecting the shape of the corresponding cutter pocket, to increase the resultant braze thickness at the one or more regions to spread out or otherwise redistribute the loading at the braze interface.

Statement 17. The method of statement 16, wherein identifying one or more regions to increase a thickness of a braze interface comprises identifying a region where the braze interface is expected to be in tension, and wherein selecting the shape of the corresponding cutter pocket to increase the resultant braze thickness at the one or more regions comprises positioning a recess at the region where the braze interface is expected to be in tension.

Statement 18. The method of statement 16 or 17, wherein selecting the shape of the corresponding cutter pocket comprises defining an annular recess between the corresponding cutter pocket and the respective substrate.

Statement 19. The method of statement 16, wherein selecting the shape of the corresponding cutter pocket comprises defining a recess on a bottom end of the corresponding cutter pocket.

Statement 20. A method of drilling a wellbore, comprising: rotating a bit body about a rotational axis with a plurality of cutters received into respective cutter pockets on the bit body, wherein each cutter pocket has an inner profile that defines an area of increased braze gap that conforms to an outer profile of the respective substrate, and with a braze interface comprising a braze alloy disposed in each cutter pocket between the inner profile of the cutter pocket and the outer profile of the respective substrate, such that a thickness of the braze alloy is greater at the area of increased braze gap.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A drill bit, comprising:

a bit body defining a rotational axis and having a plurality of cutter pockets formed thereon, each cutter pocket shaped to receive a respective substrate of a cutter;

wherein each cutter pocket has an inner profile that includes a bottom surface and a back surface, wherein at least a portion of the bottom surface includes an annular groove, wherein the annular groove defines an area of increased braze gap between the inner profile of the cutter pocket and an outer profile of the respective substrate, wherein the annular groove spans less than 180 degrees of the circumference of the inner profile of the cutter pocket, wherein the annular groove includes an axial length of between 30% to 90% of an overall length of the cutter pocket, and wherein the annular groove extends axially along the cutter pocket from a pocket front of the cutter pocket toward a pocket back of the cutter pocket, and wherein the annular groove includes a variable thickness at least partially defined by a taper, wherein the taper extends in a circumferential direction with respect to the inner profile of the cutter pocket; and a braze interface comprising a braze alloy disposed in each cutter pocket between the inner profile of the cutter pocket and the outer profile of the respective substrate, such that a thickness of the braze alloy is greater at the area of increased braze gap.

2. The drill bit of claim 1, further comprising a uniform gap between the inner and outer profiles outside the area of increased braze gap.

3. The drill bit of claim 1, wherein the braze interface includes a region of compression and a region of tension under a drilling loading, and wherein the area of increased braze gap is positioned in the cutter pocket within the region of tension.

4. The drill bit of claim 1, wherein the thickness of the braze alloy along the area of increased braze gap is between 0.010 inches and 0.040 inches.

5. The drill bit of claim 1, wherein the braze alloy comprises at least one alloy selected from the group consisting of a copper alloy, a nickel alloy, a silver alloy, a gold alloy, and combinations thereof.

6. The drill bit of claim 1, wherein the annular groove spans between 60 degrees and 120 degrees.

7. The drill bit of claim 1, wherein at least a portion of the annular groove has a second taper, and wherein the area of increased braze gap includes a variable thickness at least partially defined by the second taper.

8. The drill bit of claim 7, wherein the second taper is in a direction from the pocket front of the cutter pocket toward the pocket back of the cutter pocket.

9. The drill bit of claim 1, further comprising a spacer disposed between the inner profile of the cutter pocket and the outer profile of the respective substrate.

10. A drill bit, comprising:

a bit body defining a rotational axis and having a plurality of cutter pockets formed thereon, each cutter pocket shaped to receive a respective substrate of a cutter;

wherein each cutter pocket has an inner profile that includes a bottom surface and a back surface, wherein an annular groove includes at least a portion of the bottom surface having a taper in a direction from a pocket front of the cutter pocket toward a pocket back of the cutter pocket, and wherein the annular groove further includes at least a portion of a back surface of the cutter pocket having a taper in a direction from the bottom surface toward a pocket top of the cutter pocket, wherein the annular groove at least partially defines an area of increased braze gap between the inner profile of the cutter pocket and an outer profile of the respective substrate, wherein the area of increased braze gap extends along the taper between the cutter pocket and the substrate, wherein the area of increased braze gap includes a variable thickness at least partially defined by the taper of the annular groove; and a braze interface comprising a braze alloy disposed in each cutter pocket between the inner profile of the cutter pocket and the outer profile of the respective substrate, such that a thickness of the braze alloy is greater at the area of increased braze gap.

11. The drill bit of claim 10, wherein the annular groove spans less than 180 degrees.

12. The drill bit of claim 10, wherein the annular groove extends a full 360 degrees.

13. A braze joint, comprising:

a cutter substrate having an outer profile;

a cutter pocket for receiving the cutter substrate and having an inner profile that conforms to the outer profile of the substrate, wherein the inner profile includes a bottom surface and a back surface, wherein at least a portion of the bottom surface includes an annular groove, wherein the annular groove defines an area of increased braze gap between the inner profile of the cutter pocket and an outer profile of the substrate, wherein the annular groove includes an axial length of between 30% to 90% of an overall length of the cutter pocket, and wherein the annular groove extends axially along the cutter pocket from a pocket front of the cutter pocket toward a pocket back of the cutter pocket, and wherein the annular groove includes a variable thickness at least partially defined by a taper, wherein the taper extends in a circumferential direction with respect to the inner profile of the cutter pocket; and a braze interface comprising a braze alloy disposed in the cutter pocket between the inner profile of the cutter pocket and the outer profile of the cutter substrate, whereby the braze alloy has a greater thickness in the area of increased braze gap.

14. The braze joint of claim 13, wherein the annular groove spans less than 180 degrees.

15. The braze joint of claim 13, wherein the annular groove extends a full 360 degrees.

16. A method of drilling a wellbore, comprising:

rotating a bit body about a rotational axis with a plurality of cutters received into respective cutter pockets on the bit body, wherein each cutter pocket has an inner profile that includes a bottom surface and a back surface, wherein at least a portion of the bottom surface includes an annular groove, wherein the annular groove defines an area of increased braze gap between the inner profile of the cutter pocket and an outer profile of a respective substrate of the cutter, wherein the annular groove spans less than 180 degrees of the circumference of the inner profile of the cutter pocket, wherein the annular groove includes an axial length of between 30% to 90% of an overall length of the cutter pocket, and wherein the annular groove extends axially along the cutter pocket from a pocket front of the cutter pocket toward a pocket back of the cutter pocket, and wherein the annular groove includes a variable thickness at least partially defined by a taper, wherein the taper extends in a circumferential direction with respect to the inner profile of the cutter pocket, and wherein a braze interface comprising a braze alloy is disposed in each cutter pocket between the inner profile of the cutter pocket and the outer profile of the respective substrate, such that a thickness of the braze alloy is greater at the area of increased braze gap.

17. The method of claim 16, wherein the shape of each cutter pocket is configured to increase the resultant braze thickness at one or more regions of the braze interface to spread out or otherwise redistribute the loading at the braze interface, wherein the one or more regions are identified in response to determining an expected loading on each cutter of the plurality of cutters.

18. The method of claim 17, wherein the one or more regions include regions where the braze interface is expected to be in tension, and wherein the shape of each cutter pocket includes a respective annular groove positioned at a corresponding region of the one or more regions where the braze interface is expected to be in tension.

19. The method of claim 16, wherein the area of increased braze gap further comprises a recess on a bottom end of the at least one cutter pocket.

* * * * *